US005499090A

United States Patent [19]

Ito et al.

[11] Patent Number: 5,499,090

[45] Date of Patent: Mar. 12, 1996

[54] IMAGE FORMING APPARATUS HAVING A TONER RECYCLING MECHANISM

[75] Inventors: Noboru Ito, Kawanishi; Hiroshi Murasaki, Ibaraki; Hirokazu Yoshida, Ashiya; Fumio Masuda, Sakai, all of Japan

[73] Assignee: Minolta Camera Kabushiki Kaisha, Osaka, Japan

[21] Appl. No.: 74,451

[22] Filed: Jun. 10, 1993

[30] Foreign Application Priority Data

| | | | |
|---|---|---|---|
| Jun. 15, 1992 | [JP] | Japan | 4-154782 |
| Dec. 7, 1992 | [JP] | Japan | 4-326740 |
| Jan. 12, 1993 | [JP] | Japan | 5-003220 |
| Apr. 19, 1993 | [JP] | Japan | 5-091182 |

[51] Int. Cl.[6] ..... G03G 21/00

[52] U.S. Cl. ..... 355/298; 355/210; 355/260

[58] Field of Search ..... 355/298, 200, 355/210, 260, 257, 253; 222/DIG. 1; 118/652, 656–658

[56] References Cited

U.S. PATENT DOCUMENTS

| | | | |
|---|---|---|---|
| 3,983,841 | 10/1976 | Norton | 355/298 X |
| 4,376,578 | 3/1983 | Tanaka et al. | 355/253 |
| 4,389,968 | 6/1983 | Satomura | 118/652 |
| 4,941,022 | 7/1990 | Ohmura et al. | 355/298 |

FOREIGN PATENT DOCUMENTS

| | | | |
|---|---|---|---|
| 57-79980 | 5/1982 | Japan | 355/298 |
| 58-184983 | 10/1983 | Japan | 355/298 |
| 63-139383 | 6/1988 | Japan | 355/298 |
| 63-246780 | 10/1988 | Japan | 355/298 |
| 1-214888 | 8/1989 | Japan | 355/298 |

*Primary Examiner*—A. T. Grimley
*Assistant Examiner*—Shuk Y. Lee
*Attorney, Agent, or Firm*—Burns, Doane, Swecker & Mathis

[57] ABSTRACT

An image forming apparatus has a toner recycling mechanism for effecting toner recycling. The image forming apparatus includes a developing unit accommodating developer for developing an electrostatic latent image formed on the surface of a photosensitive member, a cleaning unit for recovering developer remaining on the surface of the photosensitive member after development, and a toner recycling assembly. The toner recycling assembly includes a developer conveyor pipe through which the developer recovered by the cleaning unit is conveyed to the developing unit for recycling of toner contained in the developer, and also includes a developer supply or transport pipe for supplying the developer accommodated in the developing unit to either the developer conveyor pipe or the cleaning unit.

24 Claims, 20 Drawing Sheets

IMAGE FORMING APPARATUS HAVING A TONER RECYCLING MECHANISM

BACKGROUND OF THE INVENTION

1. Field of the Invention

The present invention relates generally to an image forming apparatus employing an electrophotographic reproduction method and, more particularly, to an image forming apparatus having a toner recycling assembly or mechanism for effecting toner recycling by conveying toner recovered by a cleaning unit to a developing unit.

2. Description of Related Art

Image forming apparatus are in wide practical use today wherein an electrostatic latent image formed on a support member such as, for example, a photosensitive drum is developed by a developing unit using powdered developer accommodated therein. A developing unit accommodating two-component developer consisting of toner and carrier, a developing unit accommodating monocomponent magnetic developer consisting of magnetic toner, and a developing unit accommodating monocomponent non-magnetic developer consisting of non-magnetic toner, and the like are known. In these developing units, the toner contained in the developer is consumed such that the toner adheres to an electrostatic latent image formed on the surface of the electrostatic latent image support member during development. However, part of the toner adhering to the electrostatic latent image is consumed without contributing to any image formation. More specifically, that portion of the toner which has adhered to the surface of the electrostatic latent image support member but has not been transferred to a transfer material such as, for example, a transfer paper or an intermediate transfer material is removed or recovered by the cleaning unit and is disposed of. In order to eliminate waste of the toner for the effective use thereof, various attempts have been made for toner recycling by conveying the toner recovered by the cleaning unit to the developing unit. Although such attempts greatly contribute to the elimination of waste of the toner, the following new problem occurs.

In general, the toner is surface-treated with a fluid material such as, for example, silica, thereby enhancing the fluidity of the toner. The toner recovered by the cleaning unit is, however, subjected to various stresses by contacting the transfer material or the like. Because of this, the fluid material on the surface of the toner tends to be separated therefrom or tends to be embedded therein, thereby reducing the fluidity of the toner. Accordingly, the toner recovered by the cleaning unit occasionally aggregates when being conveyed to the developing unit or inside the developing unit, or is accumulated without being sufficiently mixed with the developer in the developing unit. As a result, a noise such as "fogging" occurs on an image.

SUMMARY OF THE INVENTION

The present invention has been developed to overcome the above-described disadvantages.

It is accordingly an object of the present invention to provide an improved image forming apparatus capable of preventing the fluidity of developer recovered by a cleaning unit from reducing and preventing the developer from aggregating, thereby enhancing the degree of mixing of the recovered developer with developer accommodated in a developing unit.

Another object of the present invention is to provide an image forming apparatus of the above-described type which has a simple construction and can be readily manufactured at a low cost.

A further object of the present invention is to provide an image forming apparatus wherein reversely charged toner contained in the recovered developer and having a polarity opposite to the polarity of the normal toner is supplied to the developing unit again after such toner has been appropriately charged so as to have the normal polarity.

A still further object of the present invention is to provide an image forming apparatus wherein the developer from which foreign substances such as paper powder, the reversely charged toner or the like contained in the recovered developer have been removed is supplied to the developing unit.

In accomplishing the above and other objects, an image forming apparatus according to the present invention comprises a developing unit accommodating developer for developing an electrostatic latent image formed on a surface of an electrostatic latent image support member, a cleaning unit for recovering developer remaining on the surface of the electrostatic latent image support member after development, a developer conveyor means for connecting the developing unit to the cleaning unit, thereby conveying the developer recovered by the cleaning unit to the developing unit, and a developer supply means for supplying the developer accommodated in the developing unit to one of the developer conveyor means and the cleaning unit.

By the above-described construction, the developer accommodated in the developing unit is supplied to the developer which is conveyed from the cleaning unit to the developing unit by the developer conveyor means. The recovered developer and the developer supplied from the developing unit are mixed with each other during traveling thereof through the developer conveyor means. In other words, the recovered developer having a bad fluidity is mixed with and dispersed in the developer having a good fluidity so that an appropriate fluidity may be imparted to the recovered developer. Accordingly, the recovered developer is conveyed to the developing unit without aggregating into a mass and is dispersed uniformly in the developer accommodated in the developing unit.

In applications where the developing unit accommodates two-component developer containing toner and carrier, recovered toner is appropriately charged for recycling thereof by contacting the carrier contained in the developer supplied thereto.

Advantageously, the developer conveyor means includes an impurity sorting means for removing impurities or foreign substances contained in the recovered developer. When the recovered developer is conveyed to the developing unit by the developer conveyor means, the impurity sorting means removes impurities such as, for example, paper powder contained in the developer, and therefore, only reusable developer containing no impurities is supplied to the developing unit.

In applications where the two-component developer consisting of toner and carrier is employed and where the developer which is supplied to the toner conveyed to the developing unit by the developer conveyor means has a relatively low toner density, the frequency at which recovered toner particles contact carrier particles becomes high. As a result, insufficiently charged toner is positively appropriately charged and supplied to the developing unit.

BRIEF DESCRIPTION OF THE DRAWINGS

The above and other objects and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

Figure 1:
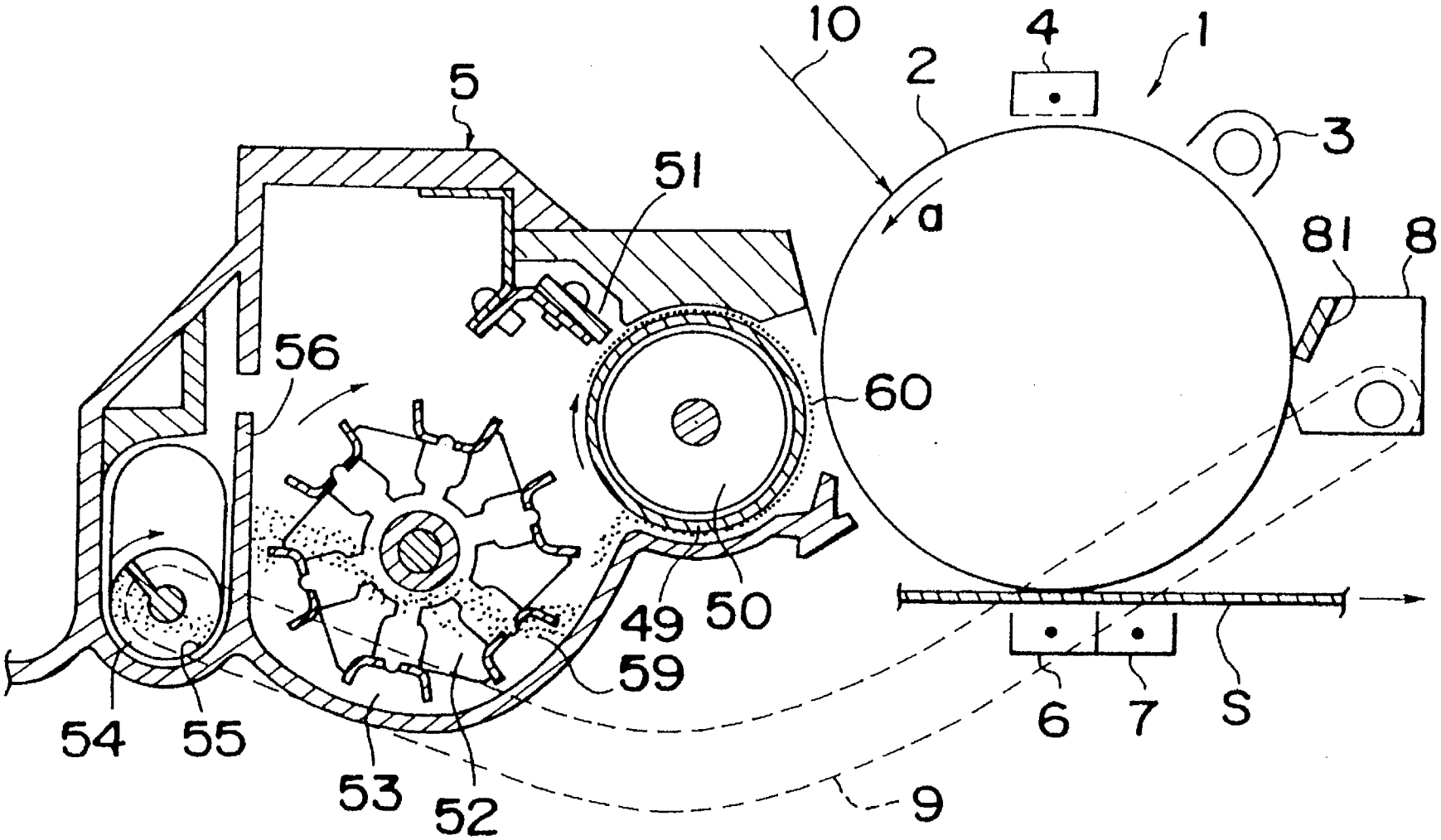
FIG. 1 is a schematic vertical sectional view of an image forming apparatus according to a first embodiment of the present invention.

Referring now to the drawings, there is schematically shown in FIG. 1 an image forming apparatus 1 employing an electrophotographic reproduction method and embodying the present invention. The image forming apparatus 1 is internally provided with a photosensitive member 2 in the form of a drum having a photosensitive layer formed on the outer peripheral surface thereof. The photosensitive drum 2 can freely rotate in a direction shown by an arrow (a). Along the outer peripheral surface of the photosensitive drum 2 are disposed an eraser lamp 3, a corona charger 4, a developing unit 5, a transfer charger 6, a separation charger 7, and a cleaning unit 8 in this order in the direction of rotation of the photosensitive drum 2. The developing unit 5 and the cleaning unit 8 are connected to each other via a toner recycling assembly or mechanism 9.

In the image forming apparatus 1 of the above-described construction, after electric charge on the outer peripheral surface of the photosensitive drum 2 has been erased by the action of illumination of the eraser lamp 3, the outer peripheral surface of the photosensitive drum 2 is charged at a predetermined potential by the action of discharge of the corona charger 4. Image-carrier light 10 from an exposure unit (not shown) is then applied to the charged surface of the photosensitive drum 2, thereby forming an electrostatic latent image corresponding to an image to be reproduced. Thereafter, the electrostatic latent image is made visible, as a toner image, by the developing unit 5, and the toner image is transferred onto a transfer medium S such as, for example, a paper by the action of discharge of the transfer charger 6. After the transfer medium S has been separated from the photosensitive drum 2 by the separation charger 7, the toner image is fixed thereon by a fixing unit (not shown), and the transfer medium S is discharged. On the other hand, toner remaining on the surface of the photosensitive drum 2 without being transferred onto the transfer medium S is recovered by the cleaning unit 8 and is conveyed to the developing unit 5 by the toner recycling assembly 9.

The developing unit 5 is internally provided with a non-magnetic cylindrical sleeve 49 rotatably mounted therein and confronting the photosensitive drum 2, a magnetic roller 50 fixedly mounted in the sleeve 49, and a bristle height regulating member 51 disposed above the sleeve 49. A free end of the bristle height regulating member 51 confronts the sleeve 49 and is spaced a very small length away therefrom.

Figure 6:
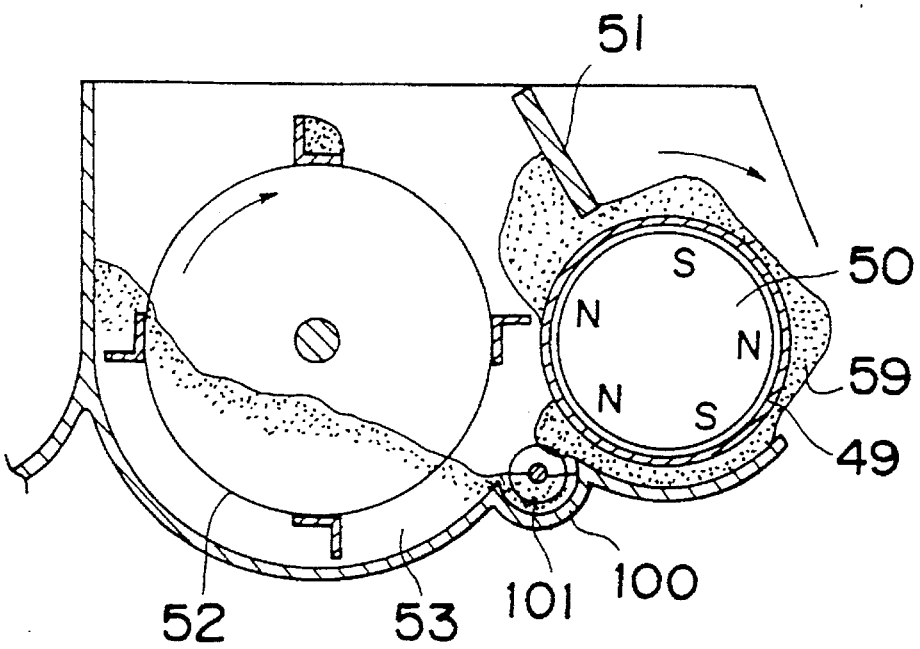
FIG. 6 is a sectional view of a developing unit accommodating a portion of another modification of the toner recycling assembly.

As best shown in FIG. 6, the magnetic roller 50 has a plurality of magnetic poles N and S formed on the peripheral surface thereof and extending in a direction longitudinally thereof, and also has a developer separating portion at which two N-poles are disposed adjacent to each other for separating the developer held on the surface of the sleeve therefrom.

Figure 2:
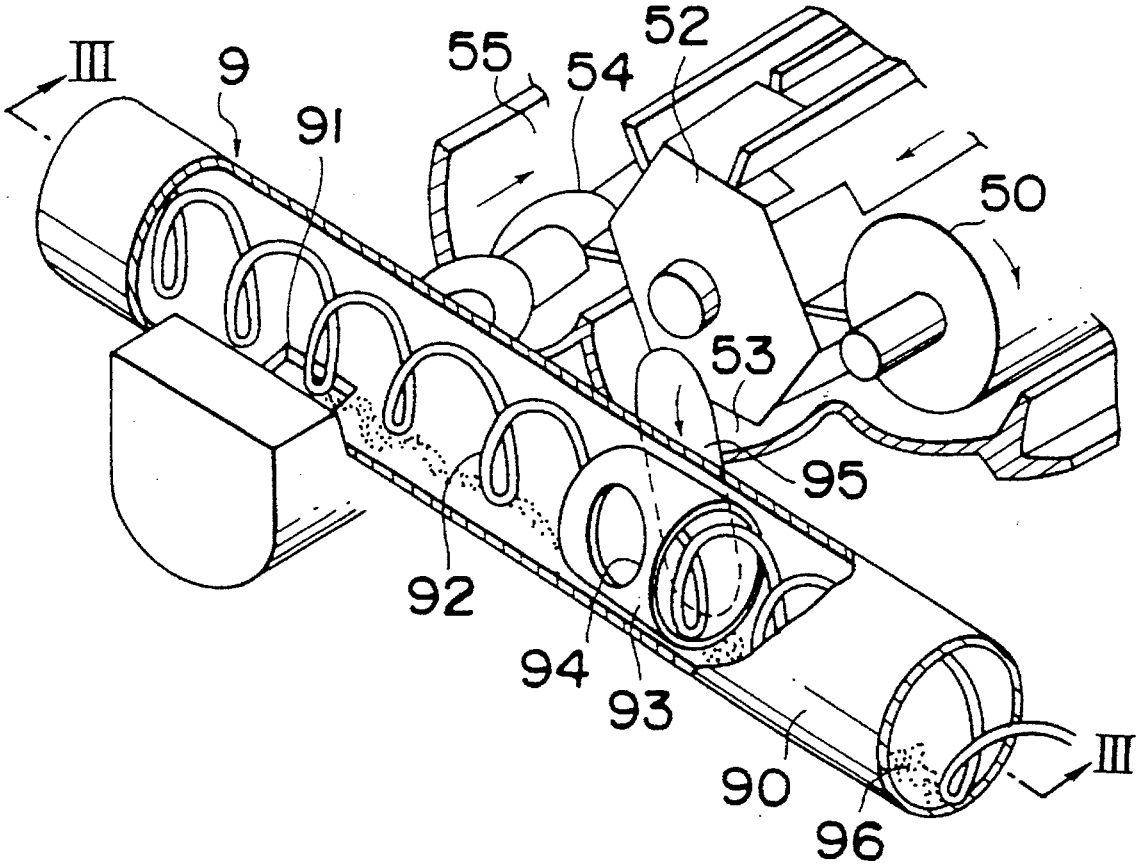
FIG. 2 is a fragmentary perspective view of a toner recycling assembly mounted in the image forming apparatus of FIG. 1.

As shown in FIG. 2, a combination of the rotatable sleeve 49 and the fixed magnetic roller 50 accommodated therein may be replaced by a developing roller rotatably mounted in the developing unit 5 for conveying developer held on the surface thereof.

The developing unit 5 has a first developer chamber 53 and a second developer chamber 55 both defined therein and positioned close to and remote from the photosensitive drum 2, respectively. The first and second developer chambers 53 and 55 accommodate a bucket roller 52 and a screw 54 extending generally parallel to each other, respectively.

Figure 9:
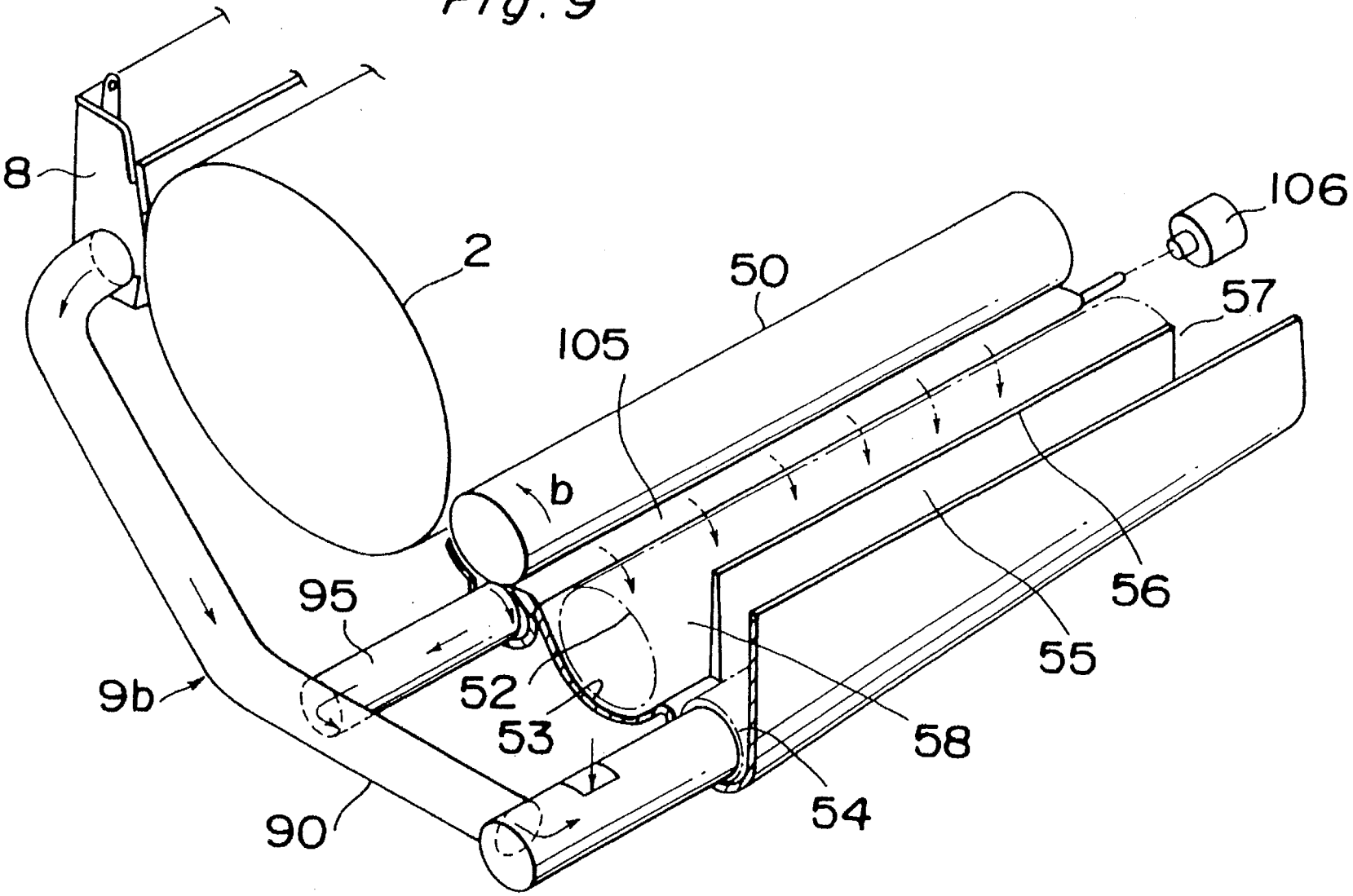
FIG. 9 is a fragmentary perspective view of the toner recycling assembly shown in FIG. 8.

As best shown in FIG. 9, the two developer chambers 53 and 55 are partitioned by a partition wall 56 but communicate with each other via communication paths 57 and 58 defined on opposite sides of the partition wall 56.

Each of the developer chambers 53 and 55 accommodates powdered two-component developer 59 consisting of toner and carrier. The developer 59 within the second developer chamber 55 is conveyed towards the communication path 57 by the screw 54 and is introduced into the first developer chamber 53 via the communication path 57. The developer 59 introduced into the first developer chamber 53 is then conveyed towards the communication path 58 by the bucket roller 52 and is introduced into the second developer chamber 55 via the communication path 58. In other words, the developer 59 is sufficiently agitated within the first and second developer chambers 53 and 55 while being circulated therein.

A portion of the developer 59 within the first developer chamber 53 is supplied to and held on the outer peripheral surface of the developing roller 50 by the bucket roller 52. While the amount of the developer 59 to be conveyed is controlled by the bristle height regulating member 51, the developer 59 is conveyed to a developing region 60 defined between the photosensitive drum 2 and the developing roller 50. At the developing region 60, toner contained in the developer 59 is fed to the electrostatic latent image formed on the surface of the photosensitive drum 2 so that the electrostatic latent image may be turned into a visible image.

Figure 3:
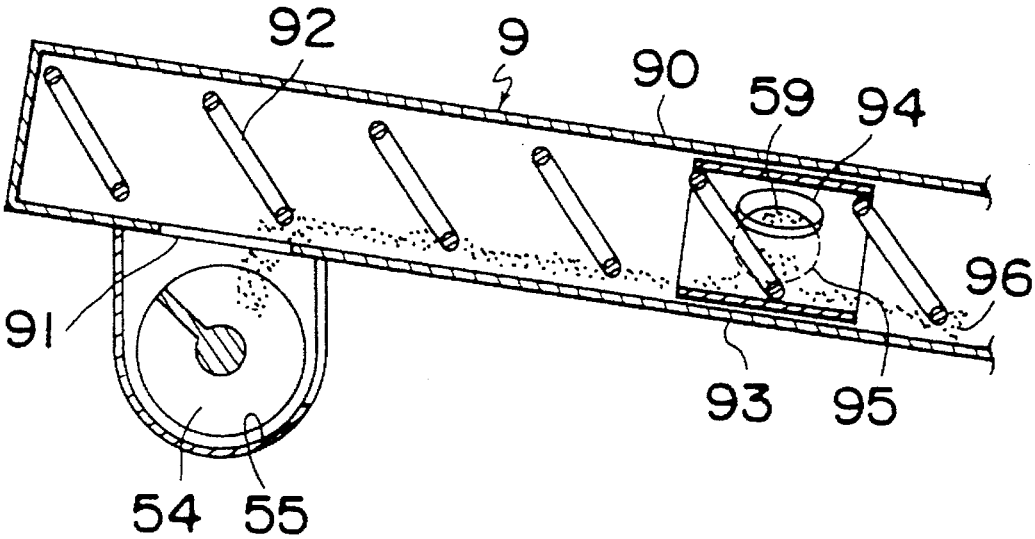
FIG. 3 is a sectional view taken along line III—III in FIG. 2.

FIGS. 2 and 3 depict the toner recycling assembly 9, which is provided with a conveyor pipe 90 made of a non-magnetic material. The conveyor pipe 90 has one end connected to the cleaning unit 8 and the other end communicating, via a developer outlet 91 defined therein, an upstream end of the second developer chamber 55 in the direction of travel of the developer 59. The conveyor pipe 90 accommodates a coil 92 rotatably mounted therein and a cylindrical member 93 having an opening 94 defined therein and secured to the coil 92 so as to cover a portion thereof. A driving source (not shown) such as, for example, an electric motor is drivingly connected to the coil 92 so as to rotate the coil 92 together with the cylindrical member 93. The conveyor pipe 90 communicates the first developer chamber 53 via a supply pipe 95, which has one end communicating a downstream end of the first developer chamber 53 in the direction of travel of the developer 59 and the other end communicating a side or upper portion of the conveyor pipe 90 at a region where the opening 94 of the cylindrical member 93 passes during the rotation thereof. The supply pipe 95 is inclined downwardly towards the conveyor pipe 90 so that the developer 59 within the developing unit 5 may be spontaneously introduced into the conveyor pipe 90 via the supply pipe 95. The supply pipe 95 may accommodate means for conveying the developer 59 to facilitate the movement of the developer 59 inside the supply pipe 95. Alternatively, the inner surface of the supply pipe 95 may be coated with Teflon or the like.

Toner 96 recovered by the cleaning unit 8 is initially introduced into the conveyor pipe 90 and is subsequently conveyed towards the developing unit 5 by the rotation of the coil 92. During the rotation of the coil 92, the opening 94 of the cylindrical member 93, which rotates together therewith, periodically communicates the supply pipe 95, thereby intermittently supplying to the conveyor pipe 90 the developer 59 spontaneously introduced into the supply pipe 95 from the first developer chamber 53. As a result, the recovered toner 96 and the carrier are mixed with each other, and reusable toner is electrostatically charged and adheres to the carrier.

Because the recovered toner 96 has been subjected to stresses caused by contacting the transfer medium S or a cleaning blade 81 accommodated in the cleaning unit 8, a fluid material is more or less separated from the surface of the recovered toner particles 96. However, because the developer 59 supplied from the developing unit 5 to the conveyor pipe 90 contains a sufficient amount of the fluid material, the mixing of the recovered toner 96 with the developer 59 supplies the recovered toner 96 with the fluid material again, thereby restoring the fluidity thereof. Accordingly, the recovered toner 96 no longer aggregates inside the conveyor pipe 90 or inside the developing unit 5 to which the recovered toner 96 is supplied, and does not adhere to the photosensitive drum 2 as the so-called "fogging".

The recovered toner 96 mixed with the developer 59 is supplied to the second developer chamber 55 via the developer outlet 91 while being conveyed by the coil 92. The recovered toner 96 supplied to the second developer chamber 55 is conveyed within the second developer chamber 55 by the rotation of the screw 54 and is mixed with the developer 59 circulated inside the developing unit 5. After the mixing, the recovered toner 96 is supplied to the photosensitive drum 2 again via the first developer chamber 53 by the developing roller 50.

Figure 4:
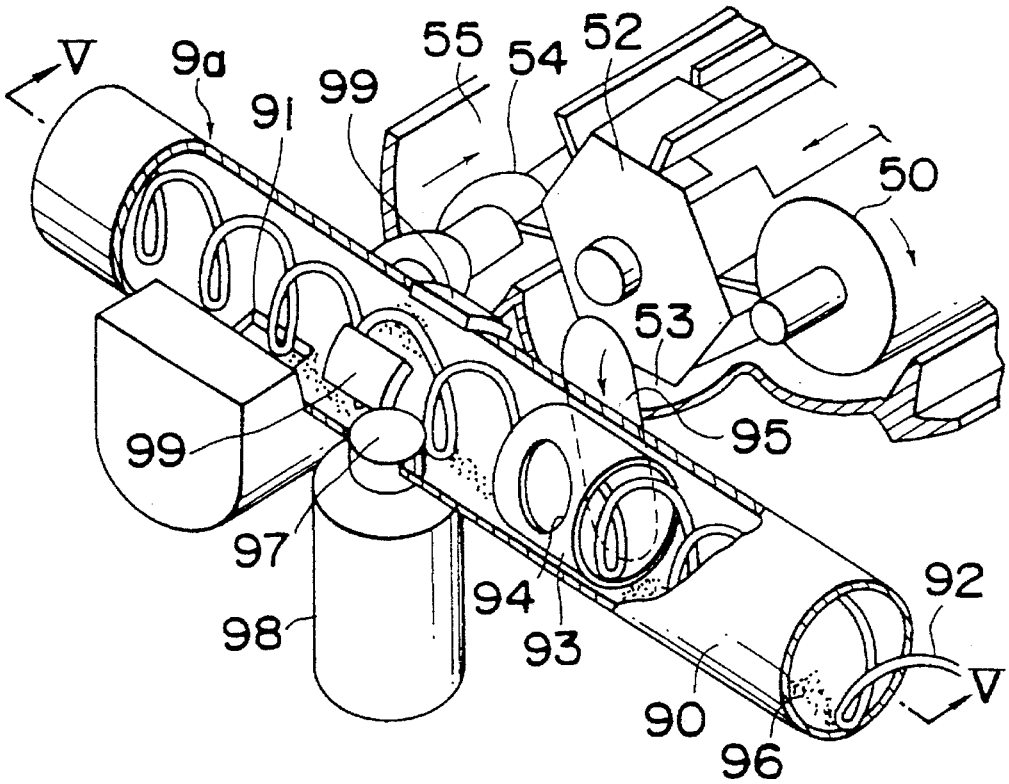
FIG. 4 is a view similar to FIG. 2, but indicating a modification thereof.
Figure 5:
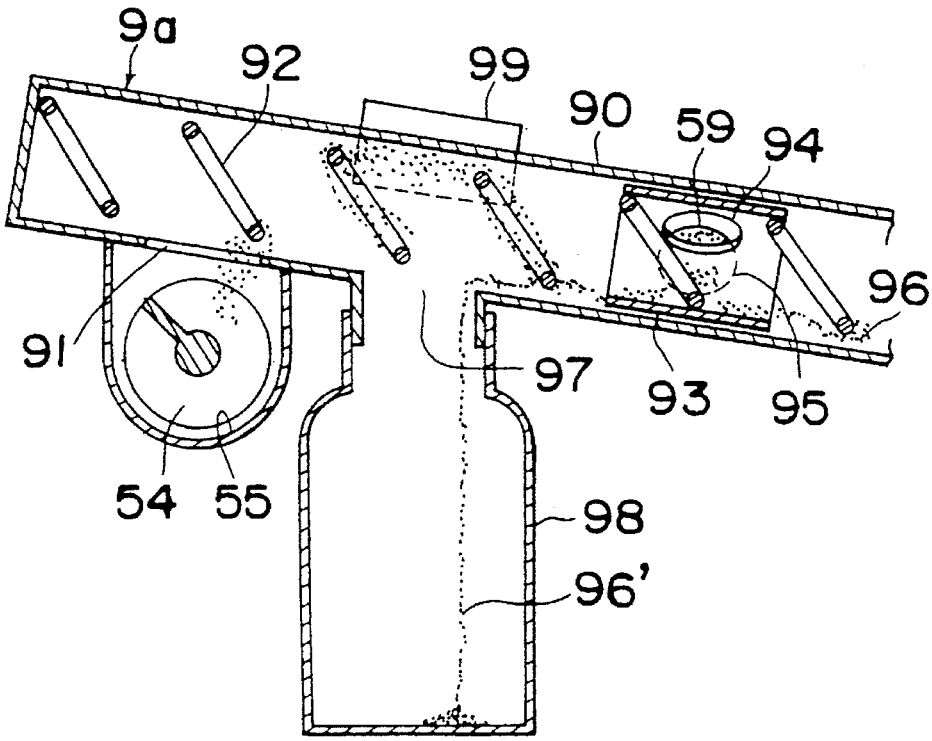
FIG. 5 is a sectional view taken along line V—V in FIG. 4.

FIGS. 4 and 5 depict a modification **9*a* of the toner recycling assembly, which has a foreign substance outlet 97 defined at a bottom portion of the conveyor pipe 90 positioned downstream from a joint between the supply pipe 95 and the conveyor pipe 90. A bottle 98 is removably mounted on a peripheral edge of the foreign substance outlet 97. A pair of opposed magnets 99 are disposed above the foreign substance outlet 97, and the coil 92** is made of a magnetic material.

In the toner recycling assembly **9*a*, the recovered toner 96 is mixed with the developer 59 supplied from the developing unit 5 via the supply pipe 95 so that reusable toner may be electrostatically charged to adhere to the carrier. However, toner which cannot be reused due to poor electrostatic charge or foreign substances 96', for example paper powder, do not adhere to the carrier. Accordingly, when the recovered toner 96 is conveyed to a location in the proximity of the foreign substance outlet 97, the toner adhering to the carrier passes over the foreign substance outlet 97 under the influence of a magnetic field produced by the paired magnets 99 and is conveyed towards the downstream side of the conveyor pipe 90. When the recovered toner 96 which has passed over the obstacle outlet 97 reaches a location not affected by the magnetic field, the recovered toner 96 drops onto the bottom of the conveyor pipe 90 and is supplied to the second developer chamber 55 through the developer outlet 91 while being conveyed by the coil 92. On the other hand, the non-charged toner or the foreign substances 96' are conveyed along the bottom surface of the conveyor pipe 90 without being affected by the magnetic field and drop into the bottle 98 through the foreign substance outlet 97**.

Figure 7:
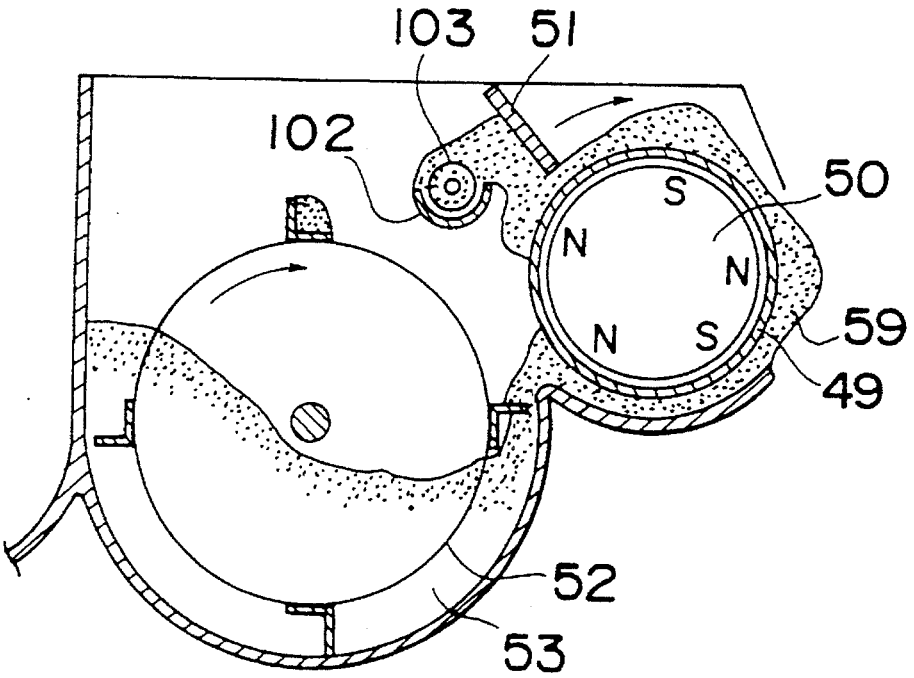
FIG. 7 is a view similar to FIG. 6, but indicating still another modification of the toner recycling assembly.

It is to be noted here that in the toner recycling assembly 9 or **9*a*, although one end of the supply pipe 95 communicates the downstream end of the first developer chamber 53 in the direction of travel of the developer 59, a developer feed path 100 accommodating a feed means 101 such as, for example, a rotatable screw may be formed between the developing roller 50 and the first developer chamber 53, as shown in FIG. 6. In this case, the developer 59 separated from the developing roller 50 is supplied to the conveyor pipe 90 through the developer feed path 100 and the supply pipe 95. Alternatively, as shown in FIG. 7, a developer feed path 102 accommodating a feed means 103 such as, for example, a rotatable screw may be formed in spaced relationship from the bristle height regulating member 51. By doing so, the developer 59 to be supplied to the developing roller 50 by the bucket roller 52 is partially supplied to the conveyor pipe 90 through the developer feed path 102 and the supply pipe 95. In applications where the developing unit 5 shown in FIG. 6 or 7 is employed, the supply pipe 95 is connected thereto in the proximity of the developer separating portion of the developing roller 50**.

Figure 8:
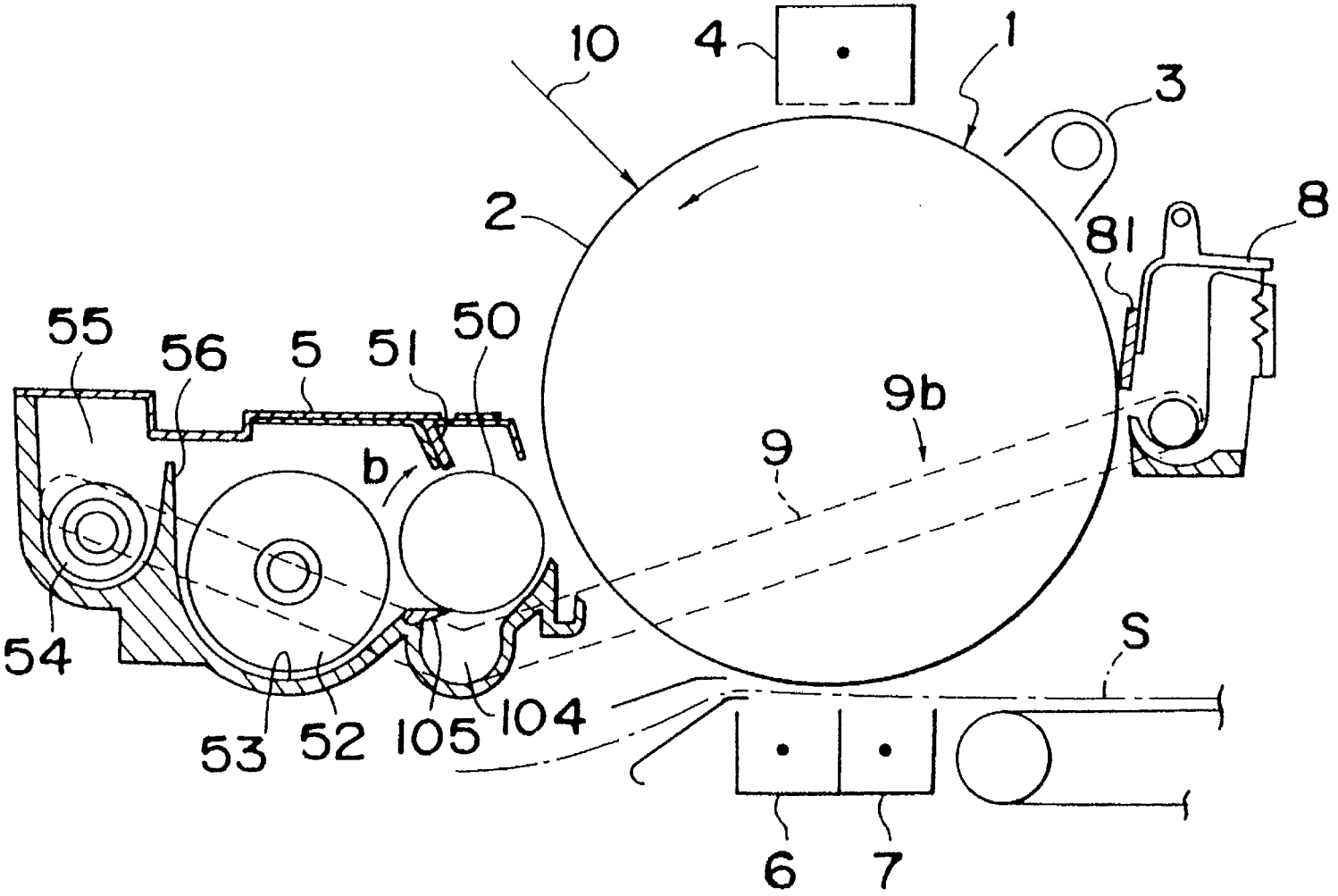
FIG. 8 is a view similar to FIG. 1, but indicating an image forming apparatus accommodating a further modification of the toner recycling assembly.
Figure 10:
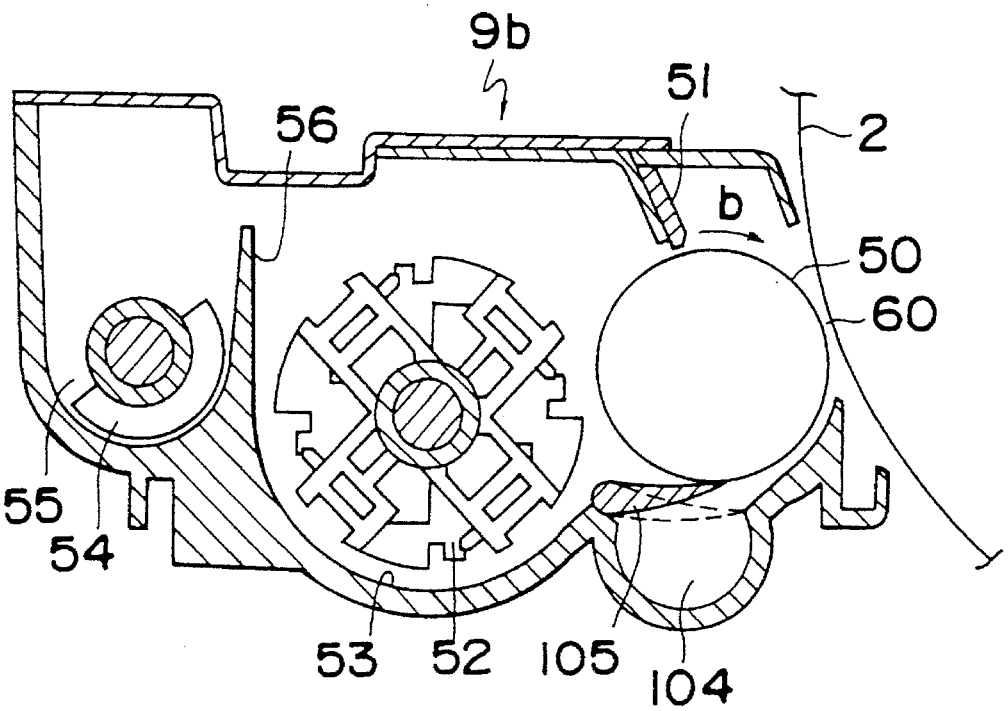
FIG. 10 is a vertical sectional view of the toner recycling assembly of FIG. 9.

FIGS. 8 through 10 depict another modification **9*b* of the toner recycling assembly, wherein the developing unit 5 has a downwardly protruding curved developer feed path 104 formed below the developing roller 50 and communicating the supply pipe 95. Above the developer feed path 104 is disposed an elongated scraper 105 having one rounded side pivotally mounted on a downstream edge of the developer feed path 104 in a direction of travel of the developer 59 (the direction shown by an arrow (b)). A solenoid or motor 106 is drivingly connected to the rounded side of the scraper 105 to switch the position of the scraper 105, thereby placing the scraper 105 at either a first position where a pointed side of the scraper 105 is in contact with the surface of the developing roller 50 (the position shown by a solid line in FIG. 10) or a second position where the former is spaced away from the latter (the position shown by a dotted line in FIG. 10**).

In the toner recycling assembly **9*b* of the above-described construction, when the scraper 105 is placed at the second position, the developer 59 which has passed the developing region 60 by the rotation of the developing roller 50 is conveyed to a location confronting the bucket roller 52, at which location the developer 59 is separated from the surface of the developing roller 50 and is recovered onto the first developer chamber 53. On the other hand, when the scraper 105 is placed at the first position, the developer 59 which has passed the developing region 60 by the rotation of the developing roller 50 is scraped off by the scraper 105 and is collected in the developer feed path 104. The developer 59 in the developer feed path 104 is then supplied to the conveyor pipe 90 through the supply pipe 95**.

Because the electrostatic latent image on the surface of the photosensitive drum 2 takes toner away from the developer 59 at the developing region 60, the toner density i.e., the weight ratio of the toner with respect to the carrier is reduced. As a matter of course, the toner density of the developer supplied to the conveyor pipe 90 through the developer feed path 104 is also low, whereas the weight ratio of the carrier is high. Because of this, the frequency at which recovered toner particles contact carrier particles in the developer becomes high, and insufficiently charged toner in the recovered toner is appropriately charged by the contact thereof with the carrier for recycling thereof.

In order to smoothly convey the developer collected in the developer feed path 104, it is preferable to incline the developer feed path 104 downwardly towards the supply pipe 95. Also, coating the inner surface of the developer feed path 104 with Teflon or the like facilitates the smooth movement of the developer 59. As a matter of course, a developer conveyor means (not shown) such as a screw, a spiral coil or the like may be accommodated in the developer feed path 104 to readily convey the developer 59.

Figure 12:
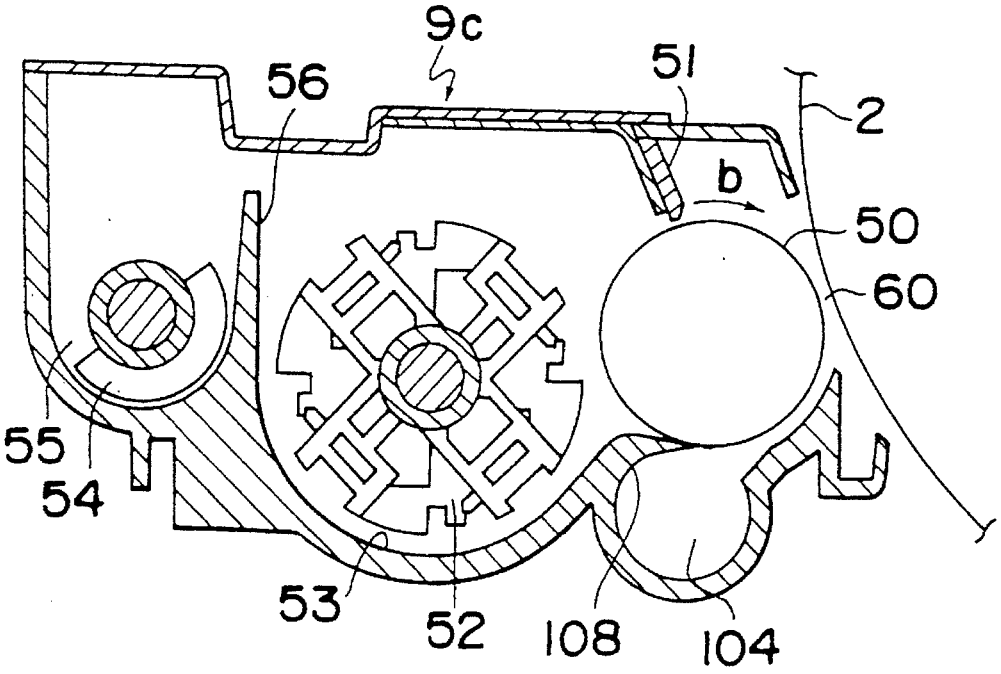
FIG. 12 is a vertical sectional view of the toner recycling assembly of FIG. 11.
Figure 11:
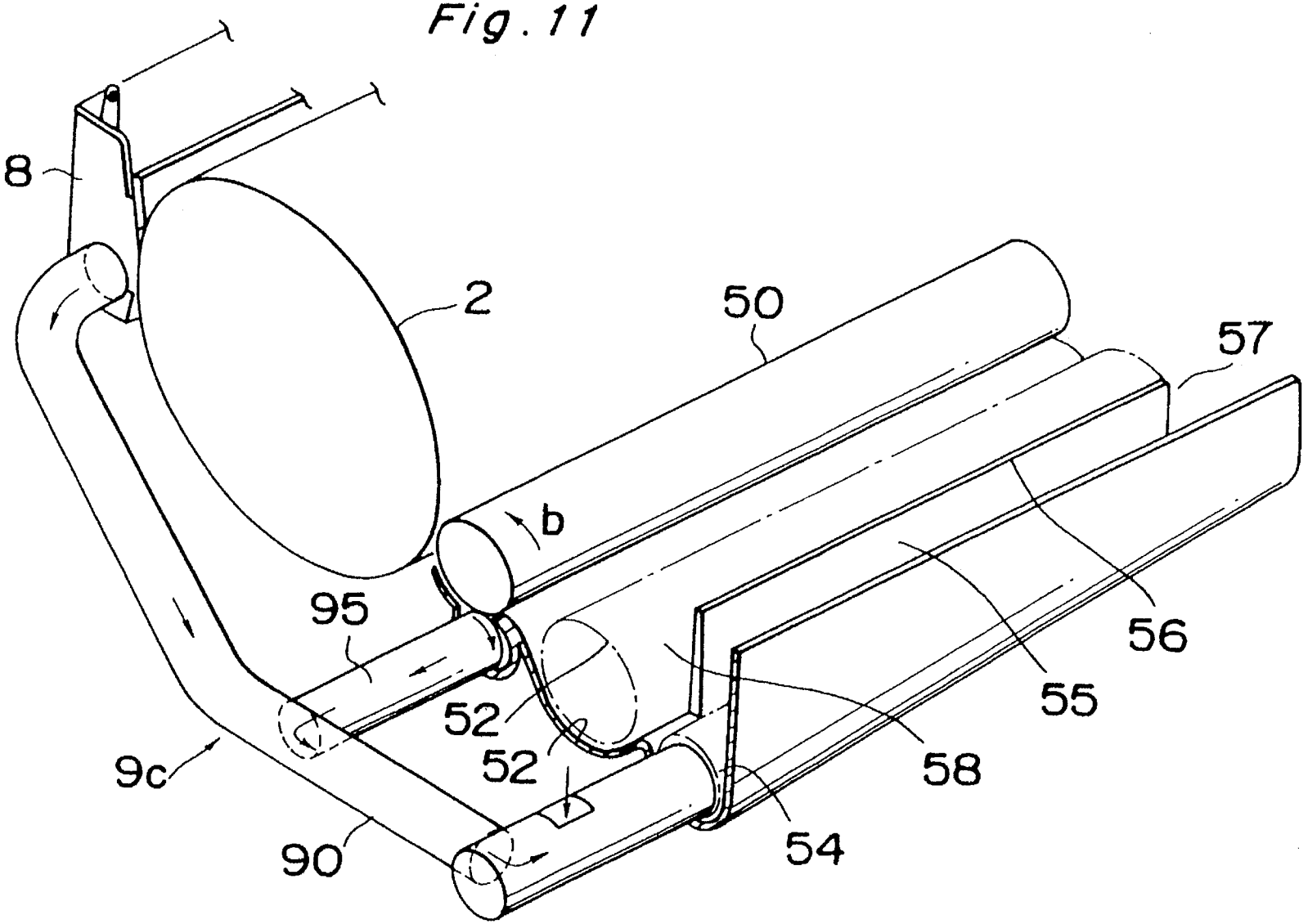
FIG. 11 is a view similar to FIG. 9, but indicating a still further modification of the toner recycling assembly.

FIGS. 11 and 12 depict a further modification **9*c* of the toner recycling assembly wherein un upper edge of a partition wall 108 for partitioning the developer feed path 104 from the first developer chamber 53 confronts the developing roller 50 and is spaced a considerably small length away therefrom. In this toner recycling assembly 9*c*, the amount of the developer 59 which has passed the developing region 60 is controlled by the partition wall 108, and a portion thereof is collected in the developer feed path 104 and is supplied to the conveyor pipe 90. An upper layer portion of the developer 59 which has passed the developing region 60 and is held on the developing roller 50** contains carrier at a considerably high weight ratio, which exhibits a superior effect in recycling the electrification characteristic of the recovered toner.

Figure 13:
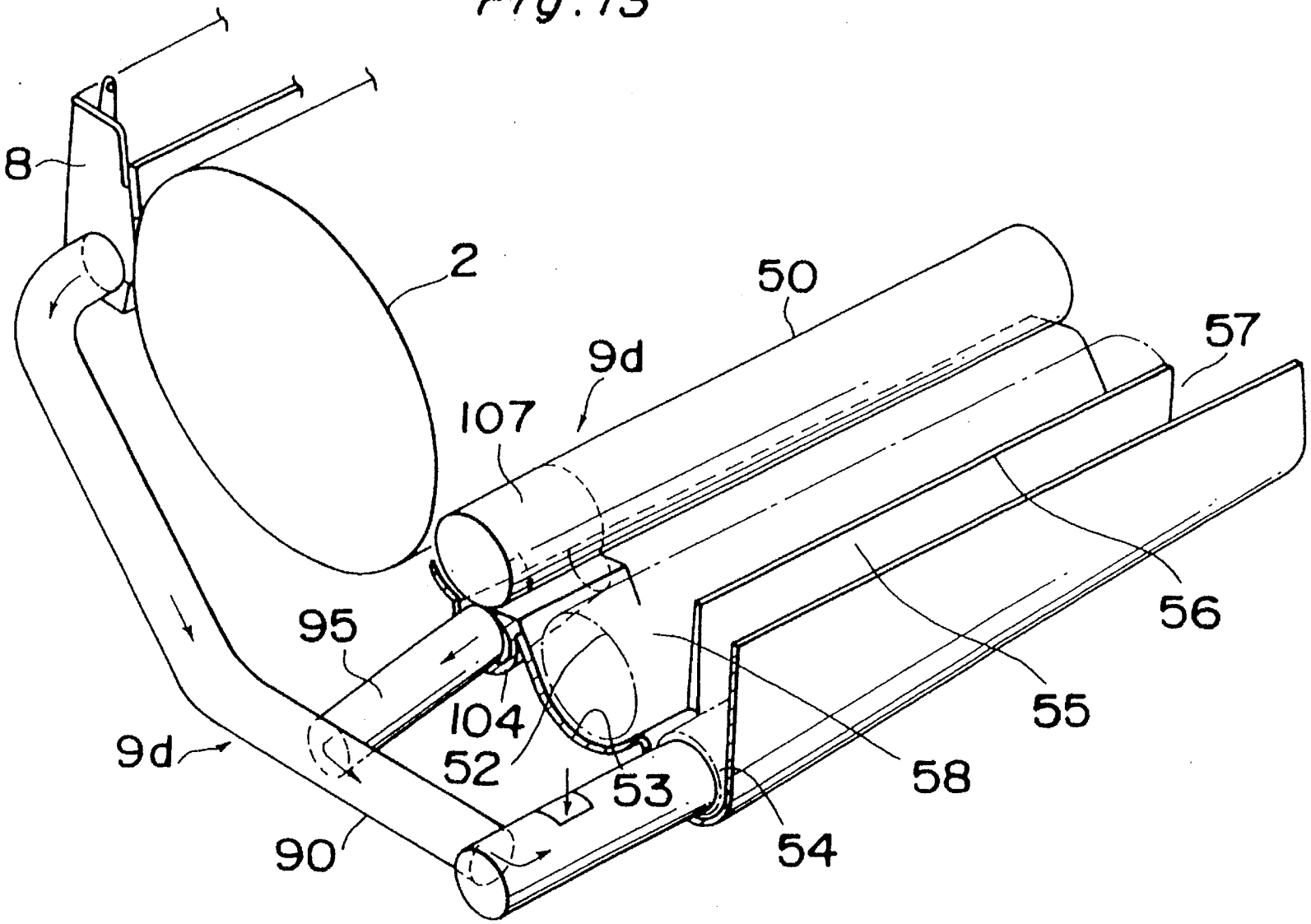
FIG. 13 is a view similar to FIG. 9, but indicating another modification of the toner recycling assembly.
Figure 14:
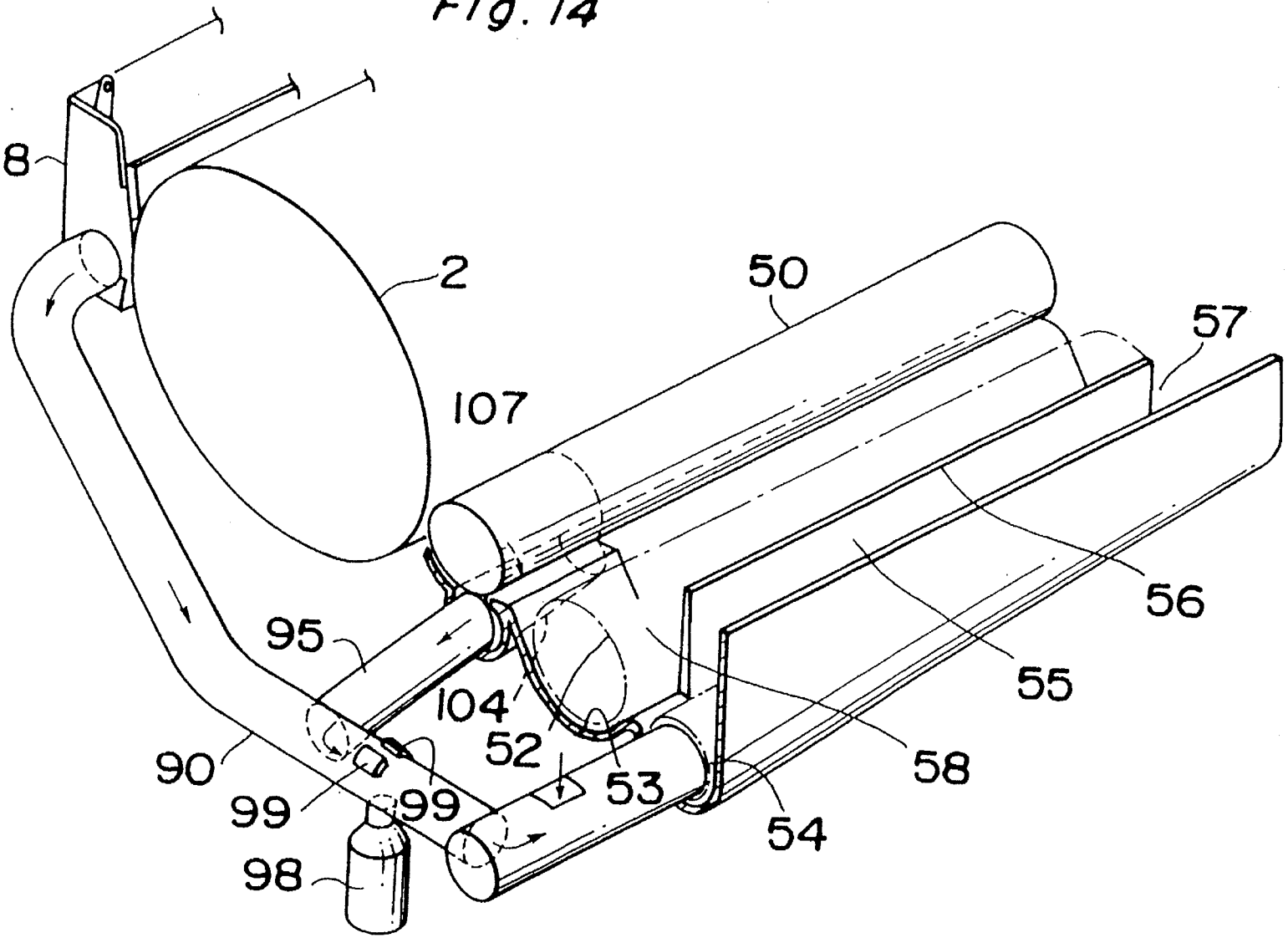
FIG. 14 is a view similar to FIG. 9, but indicating still another modification of the toner recycling assembly.

In the toner recycling assembly **9*b* or 9*c*, the developer feed path 104 extends over the overall length of the developing roller 50 in parallel therewith, and a portion of all the developer which has passed the developing region 60 is collected and supplied to the conveyor pipe 90. However, as shown in FIG. 13 depicting another modification 9*d* of the toner recycling assembly, the length of the developer feed path 104 may be in agreement with that of a non-image region 107 defined at one end portion of the developing roller 50. In this case, the developer held on only the non-image region 107 of the outer peripheral surface of the developing roller 50 is collected in the developer feed path 104 for subsequent supply thereof to the conveyor pipe 90. As a matter of course, the toner recycling assembly 9*b*, 9*c*, or 9*d* may be provided with the bottle 98 required for recovering impurities or the paired magnets 99, as shown in FIG. 14**.

Although the above discussion has been made with respect to the case wherein the developing unit accommodates two-component developer consisting of toner and carrier, the present invention is also applicable to an image forming apparatus employing monocomponent magnetic developer or monocomponent non-magnetic developer. Even in the image forming apparatus employing such monocomponent developer, mixing the recovered toner with the developer containing a fluid material provides the recovered toner with fluidity, thereby eliminating the "fogging".

A developer recycling assembly which is discussed later or an impurity sorter as disclosed in U.S. Pat. Nos. 4,389,968, 4,376,578, Japanese Laid-open Patent Publication No. 54-30832, Japanese Laid-open Patent Publication No. 61-235876, or the like can be used as an impurity sorter other than the one employed in the above-described embodiment.

Figure 15:
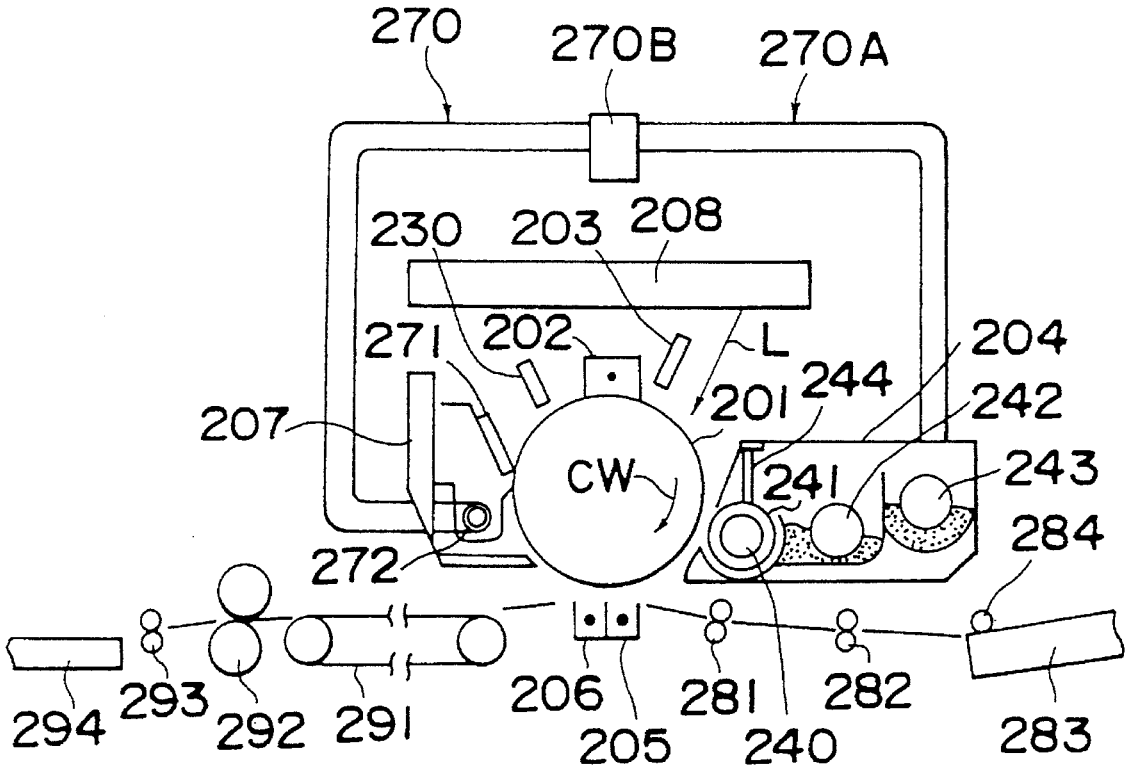
FIG. 15 is a schematic sectional view of an image forming apparatus according to a second embodiment of the present invention.

FIG. 15 depicts a copier according to a second embodiment of the present invention. The copier shown in FIG. 15 is provided at a central portion thereof with a photosensitive member 201 in the form of a drum. A corona charger 202, an inter-image eraser 203, a developing unit 204, a transfer charger 205, a separation charger 206, a cleaning unit 207, and a main eraser 230 are disposed in this order along the periphery of the photosensitive drum 201 in a direction of rotation of the photosensitive drum 201.

Figure 17:
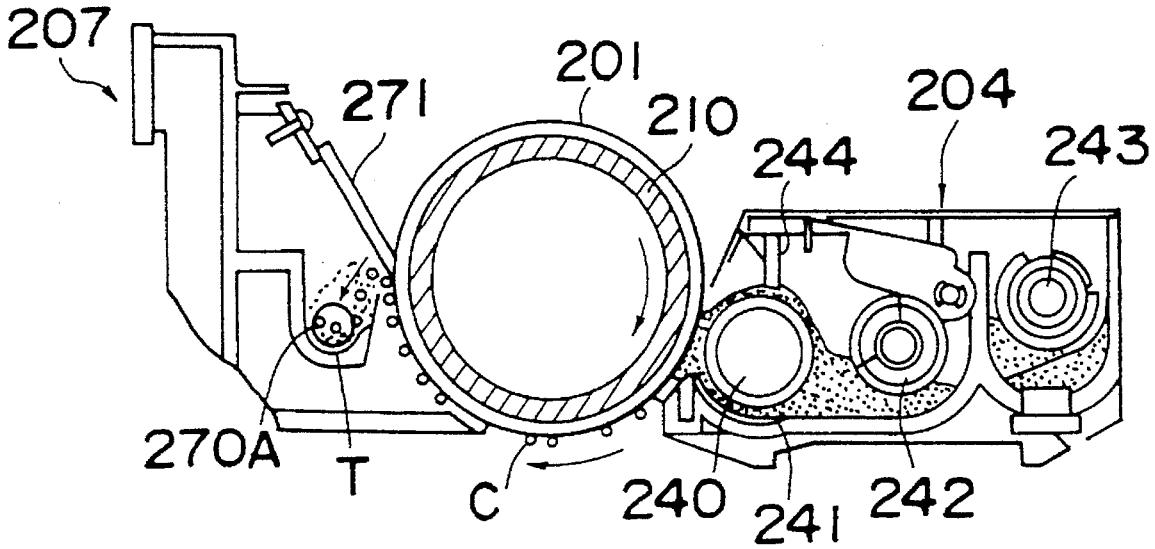
FIG. 17 is a vertical sectional view of a main portion of the image forming apparatus of FIG. 15.

As shown in FIG. 17, the developing unit 204 accommodates two-component developer consisting essentially of toner and magnetic carrier and is provided with a developing sleeve 241 accommodating a magnet 240, a bucket roller 242 adjacent to the developing sleeve 241 for supplying the developing sleeve 241 with the developer, a developer agitating roller 243 adjacent to the bucket roller 242, and a bristle height regulating member 244 having a free end confronting the developing sleeve 241. The developing sleeve 241 is coupled with and driven by a driving means (not shown). The rotation of the former caused by the latter conveys to a developing region the developer which takes the form of a magnetic brush (bristles of the developer) and is held on the developing sleeve 241 by the action of the magnet 240, thereby developing an electrostatic latent image on the photosensitive drum 201.

The cleaning unit 207 is provided with a cleaning blade 271 in contact with the surface of the photosensitive drum 201 by the biasing force of a spring.

Figure 16:
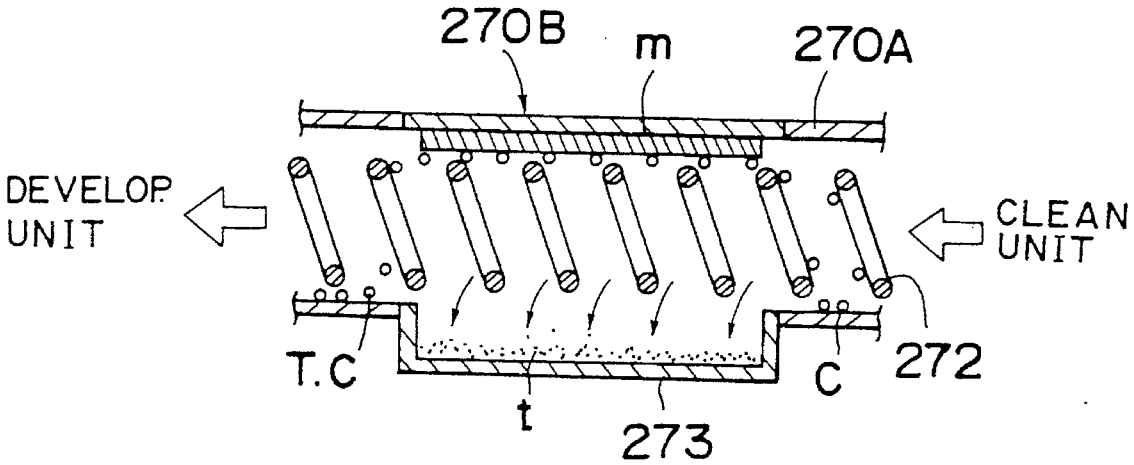
FIG. 16 is a fragmentary vertical sectional view of a recycling duct of a toner recycling assembly mounted in the image forming apparatus of FIG. 15.

This copier is also provided with a developer recycling assembly 270 for returning developer recovered by the cleaning unit 207 to the developing unit 204. The developer recycling assembly 270 has a recycling duct 270A through which the cleaning unit 207 and the developing unit 204 communicate. A magnetic filter 270B is provided at an intermediate portion of the recycling duct 270A. As best shown in FIG. 16, a conveyor coil 272, connected to a driving means (not shown), is rotatably mounted in the recycling duct 270A. The magnetic filter 270B comprises a magnet m secured to an upper portion of an inner surface of the recycling duct 270A. A recess 273 is formed below the magnet m to store unusable toner or foreign substances.

An optical system 208 is disposed above the photosensitive drum 201 and comprises a lamp for illuminating an image of a document placed on a glass platform, various mirrors, lenses, and the like.

As viewed in FIG. 15, a pair of opposed timing rollers 281, a pair of opposed intermediate rollers 282, and a paper feed cassette 283 are disposed in this order on the right of the transfer charger 205. A paper feed roller 284 is disposed above the paper feed cassette 283 to feed transfer papers placed thereon. A paper conveyor belt 291, a pair of opposed fixing rollers 292, a pair of opposed discharge rollers 293, and a paper discharge cassette 294 are disposed in this order on the left of the separation charger 206.

Figure 18:
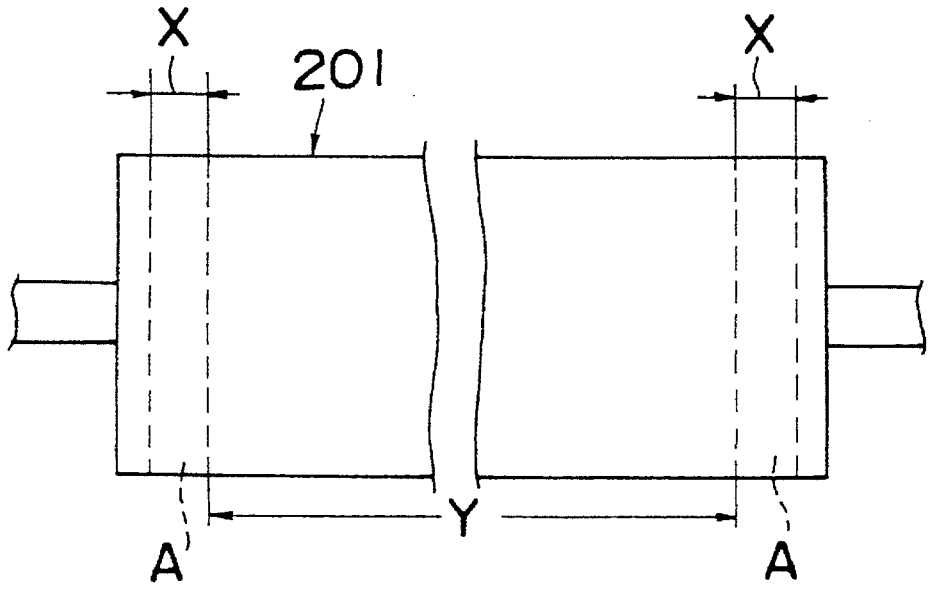
FIG. 18 is a fragmentary top plan view of a photosensitive drum mounted in the image forming apparatus of FIG. 15.

As shown in FIG. 18, the photosensitive drum 201 has an image region Y defined at a central portion thereof and two non-image regions X defined on respective sides of the image region Y in the proximity of respective ends thereof. A magnetic sheet 210 is overlaid on that portion of the entire inner peripheral surface of the photosensitive drum 201 which corresponds to each of the non-image regions X.

In this copier, upon completion of a copying operation, toner remaining on the image region Y is removed by the cleaning unit 207 and is collected in the cleaning unit 207. During the operation of the photosensitive drum 201 and the developing unit 204, the developer containing the carrier and accommodated in the developing unit 204 is adsorbed by the magnetic sheets 210 provided inside the photosensitive drum 201 under the influence of the magnetic force thereof and is held on the surface of the non-image regions X.

The developer thus held on the non-image regions X is conveyed to the cleaning unit 207 by the rotation of the photosensitive drum 201. The developer is then removed from the non-image regions X by the cleaning unit 207 and is accumulated therein.

The toner and the developer recovered inside the cleaning unit 207 are returned to the developing unit 204 through the recycling duct 270A by the operation of the conveyor coil 272 under the condition in which the normal toner T contained in the recovered toner electrostatically adheres to the carrier C contained in the developer supplied by the magnetic sheets 210. On the way, as shown in FIG. 16, while the carrier C is being held by the magnet m of the magnetic filter 270B under the influence of the magnetic force thereof, the carrier C is conveyed towards the developing unit 204. On the other hand, defective powder t such as reversely charged toner, paper powder and the like, all of which are not adsorbed by the carrier C, drops onto the recess 273 positioned below the magnet m.

It is to be noted here that although each of the magnetic sheets 210 inside the photosensitive drum 201 is employed as a magnetic field generating means, the magnetic field generating means is not limited thereby, and any other material can be employed if the carrier is held on the non-image regions defined at opposite ends of the photosensitive drum 201. For example, commercially available magnets may be employed. Furthermore, the magnetic field generating means is not necessarily required to be in contact with the inner surface of the photosensitive drum 201. Also, the magnetic field generating means is not necessarily required to be applied to that portion of the entire inner surface of the photosensitive drum 201 which corresponds to each of the non-image regions X, and may be placed within a limited range or at regular intervals. In the above-described embodiment, although the two magnetic sheets 210 are provided at opposite ends of the photosensitive drum 201, respectively, only one magnetic sheet may be provided at one end thereof.

Figure 19:
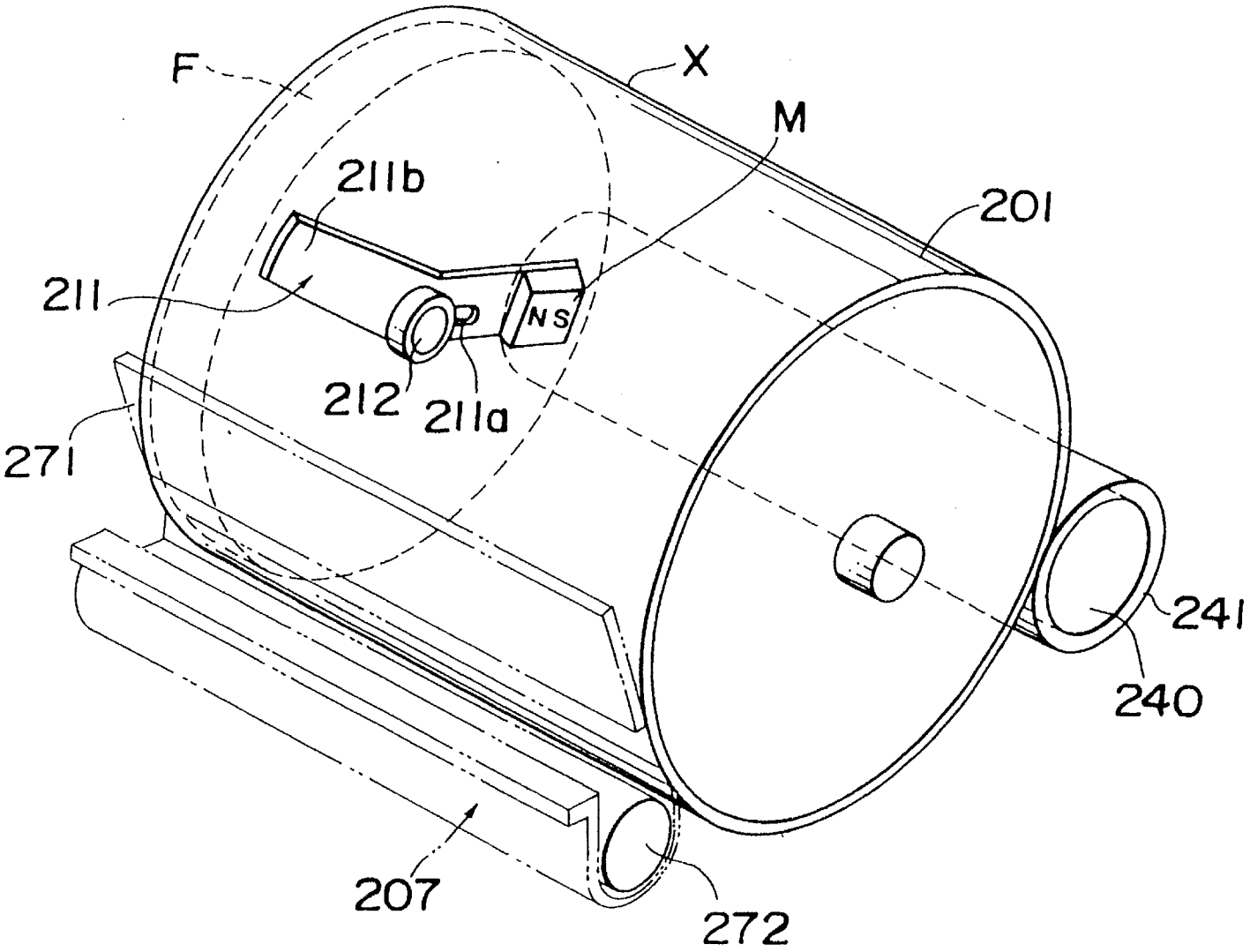
FIG. 19 is a perspective view of the photosensitive drum of FIG. 18.
Figure 20:
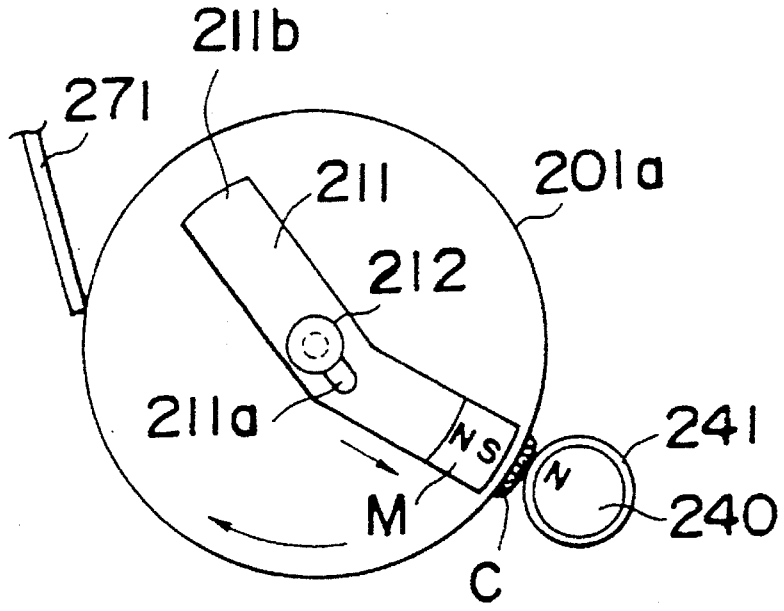
FIGS. 20 and 21 are front elevational views of a magnetic field generating means accommodated in the photosensitive drum of FIG. 19 and located at two different positions.
Figure 21:
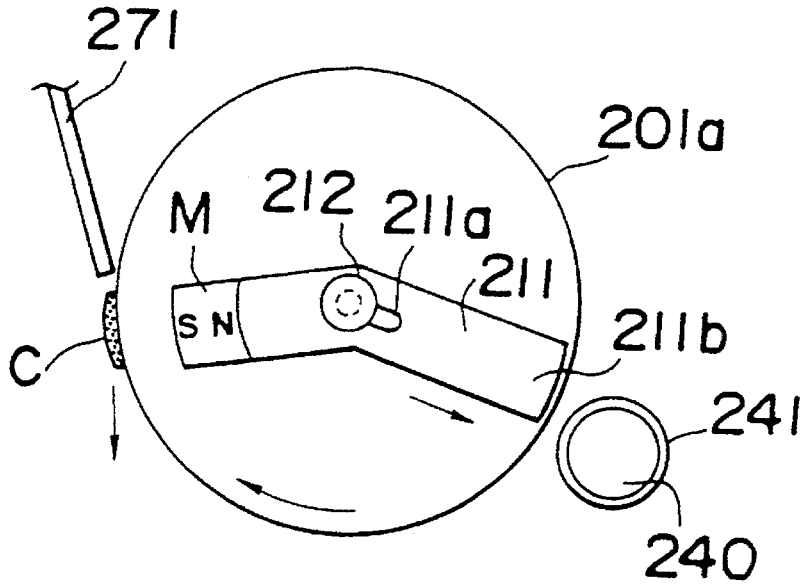

FIGS. 19 through 21 depict a modification 201*a* of the photosensitive drum 201.

The photosensitive drum 201*a* includes a flange F securely mounted on one end thereof, an inwardly protruding pin 212 secured to the center of the flange F, an angled magnet holder 211 positioned radially inwardly of a non-image region X and having an elongated opening 211*a* defined at a central portion thereof for engagement with the pin 212, and a magnet M secured to one end of the magnet holder 211. The whole magnet holder 211 is made of a magnetic material. The pin 212 extends through the elongated opening 211*a* of the magnet holder 211 and allows the magnet holder 211 to move a limited length in a direction radially of the flange F. The engagement between the pin 212 and the magnet holder 211 allows the magnet holder 211 to rotate together with the flange F but does not allow the magnet holder 211 to rotate about the pin 212.

Of two magnetic poles of the magnet M, the outwardly directed magnetic pole confronting the inner surface of the photosensitive drum 201*a* has a polarity opposite to the polarity of a developing magnetic pole of the magnet 240 accommodated in the developing sleeve 241 of the developing unit 204. In the example shown in FIG. 20, that magnetic pole of the magnet M which confronts the inner surface of the photosensitive drum 201*a* is an S-pole, whereas the developing magnetic pole of the developing unit 204 is an N-pole.

Although the photosensitive drum 201*a* employs the magnet M as a magnetic field generating means required for holding the carrier, any other suitable magnetic member can be employed if the carrier is adsorbed and held thereby on the surface of the photosensitive drum 201*a* under the influence of a magnetic field generated thereby at the time the magnetic member confronts the magnet 240 accommodated in the developing sleeve 241 of the developing unit 204.

According to a copier having the photosensitive drum 201*a*, the rotation of the photosensitive drum 201*a* is followed by the rotation of the magnet holder 211 together with the magnet M positioned radially inwardly of the nonimage region X. As shown in FIG. 20, when the magnet M reaches the location of the developing region defined between the photosensitive drum 201*a* and the developing sleeve 241, the magnet M is drawn to the magnet 240 mounted in the developing sleeve 241, thereby moving the magnet holder 211 in the radial direction of the flange F and also moving the magnet M towards the inner surface of the photosensitive drum 201*a*. As a result, the carrier C accommodated in the developing unit 204 is adsorbed by the magnetic force of the magnet M and is held on the surface of the non-image region X.

The carrier C thus held on one end portion of the photosensitive drum 201*a* i.e., on the non-image region X is conveyed to the cleaning unit 207 by the rotation of the magnet M and the magnet holder 211 together with the photosensitive drum 201*a*. As shown in FIG. 21, when the magnet M comes near the cleaning blade 271 of the cleaning unit 207, an end portion 211*b* of the magnet holder 211 opposite to the magnet M reaches the developing region and is drawn to the magnet 240 of the developing sleeve 241. At this moment, the magnet holder 211 moves relative to the pin 212 in the radial direction of the flange F by the length of the elongated opening 211*a*, thereby moving the magnet M away from the inner surface of the photosensitive drum 201*a*. As a result, the carrier C held on the photosensitive drum 201*a* drops onto the cleaning unit 207. Even if some carrier still remains on the surface of the photosensitive drum 201*a*, it is removed by the cleaning blade 271.

Both the carrier and the toner recovered in the cleaning unit 207 are returned to the developing unit 204 by the developer recycling assembly 270, and on the way, defective powder t is separated therefrom by the magnetic filter 270B.

In order to prevent the magnet M from holding the carrier on the photosensitive drum 201*a* at the time the copier is at a standstill, the stop position of the photosensitive drum 201*a* is so chosen that the magnet M may be positioned downstream from the cleaning unit 207 and upstream from the developing region.

It is to be noted here the end portion of the magnet holder 211 opposite to the magnet M may be made of a magnet if such end portion is moved, when confronting the magnet 240 accommodated in the developing sleeve 241 of the developing unit 204, towards the inner surface of the photosensitive drum 201*a* under the influence of a magnetic field generated by the magnet 240. Alternatively, only this end portion is made of a magnetic material. Furthermore, two sets of magnet holder 211 and magnet M may be mounted on opposite ends of the photosensitive drum, respectively.

In each of the copiers described above, because the developer having a good fluidity is supplied from the developing unit 204 by the magnetic field generating means, the fluidity is imparted to the recovered developer. Also, because the carrier contained in the developer which is supplied by the magnetic field generating means is held on the non-image region or regions X defined at one or both ends of the photosensitive drum 201 or 201*a*, the carrier is restrained from biting into that portion of the cleaning blade 271 which confronts the image region Y, thereby reducing wear or damage of such portion or that of the photosensitive drum 201 or 201*a* at the image region Y. Accordingly, not only the cleaning performance of the cleaning unit 207 is not lowered but also the condition of the image region Y is maintained at a desired one, and therefore, no reduction is caused in image quality. Furthermore, the life of the cleaning blade 271 or the photosensitive drum 201 or 201*a* can be prolonged.

Figure 22:
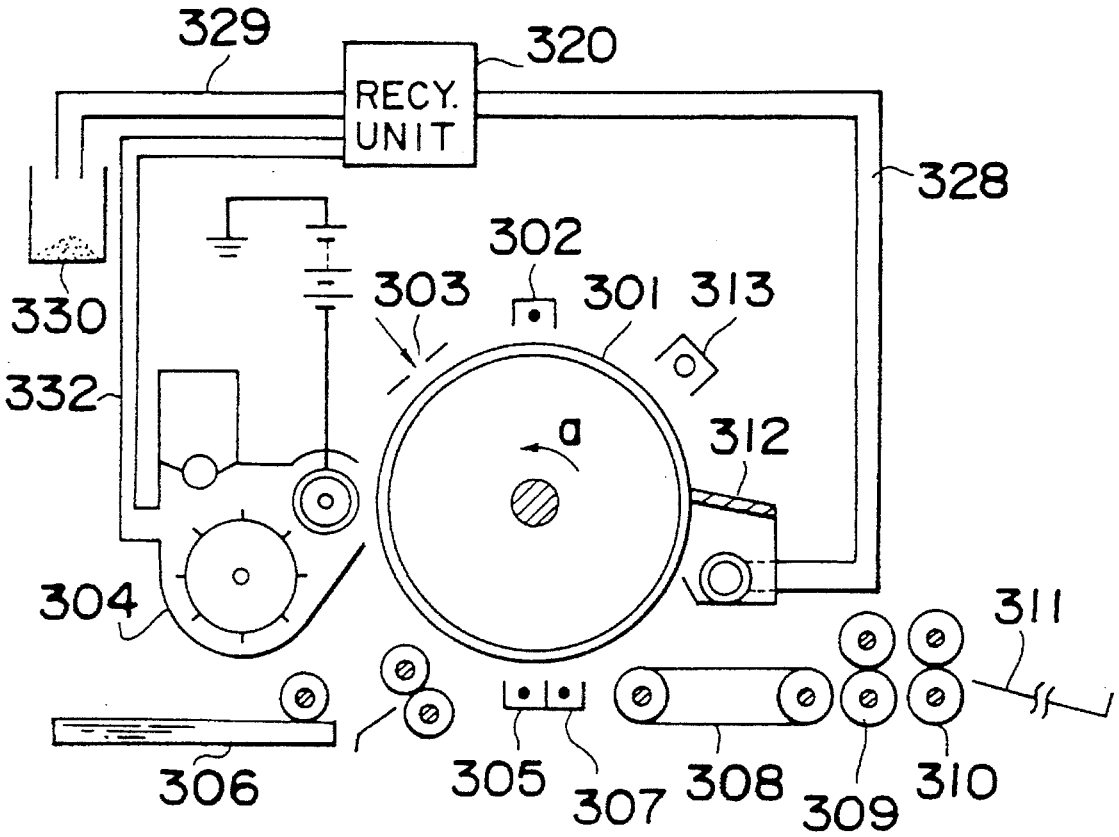
FIG. 22 is a schematic vertical sectional view of an image forming apparatus according to a third embodiment of the present invention.

FIG. 22 depicts an image forming apparatus having a developer recycling assembly according to a third embodiment of the present invention.

In this image forming apparatus, the outer peripheral surface of a photosensitive drum 301 which rotates in a direction shown by an arrow (a) is charged at a predetermined potential by a charging unit 302, and image-carrier light from an exposure unit 303 is applied to a charged region for the formation of an electrostatic latent image thereon. The electrostatic latent image is made visible as a toner image by a developing unit 304 accommodating magnetic developer, and the toner image is transferred by a transfer unit 305 onto a transfer material such as, for example, a paper supplied from a paper supply unit 306. The transfer material on which the toner image has been transferred is separated from the surface of the photosensitive drum 301 by a separation unit 307 and is then supplied by a conveyor unit 308 to a fixing unit 309 where the toner image is fixed on the transfer material. Thereafter, the transfer material is discharged onto a tray by a discharge unit 310.

Figure 23:
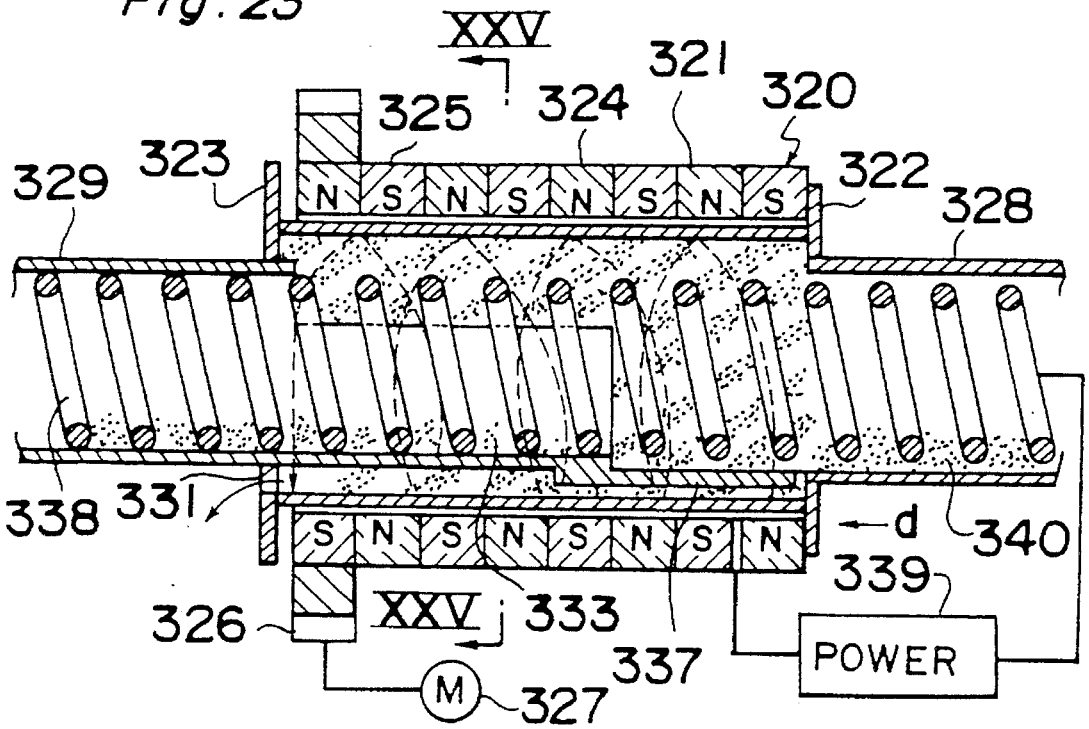
FIG. 23 is a vertical sectional view of a developer recycling unit mounted in the image forming apparatus of FIG. 22.

Because all the toner on the photosensitive drum 301 is not transferred onto the transfer material, some toner still remains on the photosensitive drum 301 from which the transfer material has been separated. The remaining toner is recovered by a cleaning unit 312 and is then introduced into a developer recycling unit 320 shown in FIG. 23 for recycling thereof. The recycled toner is again supplied to the developing unit 304. Residual electric charge on the photosensitive drum 301 from which the toner has been removed is erased by an eraser unit 313 in preparation for a subsequent image forming operation.

The developer recycling unit 320 includes a cylindrical recycling pipe 321 made of an electrically conductive non-magnetic material and two insulating non-magnetic rings 322 and 323 axially aligned therewith and secured to an upstream end and a downstream end thereof, respectively, in a direction of travel of the developer. A magnetic sleeve 324 is rotatably mounted on the outer peripheral surface of the recycling pipe 321, and the inner surface thereof is made smooth by Teflon coating.

Figure 24:
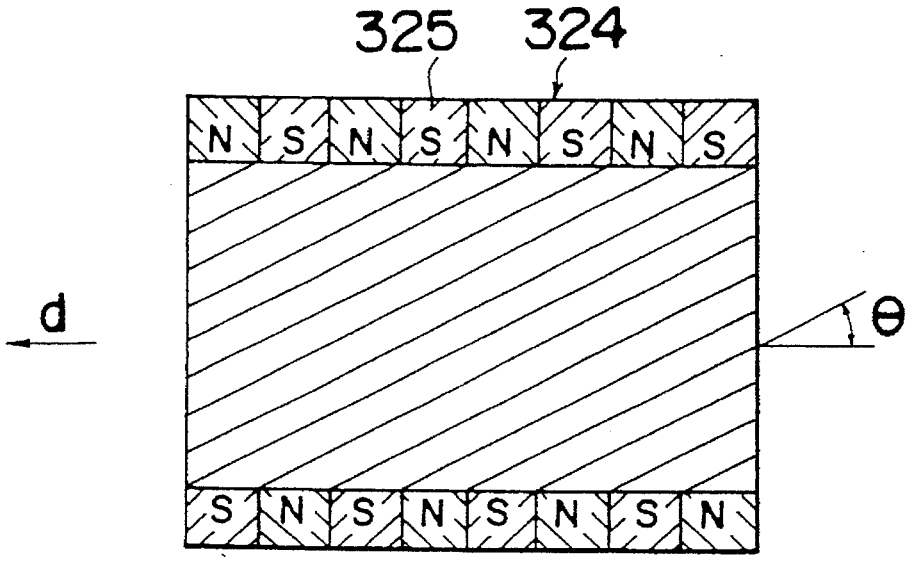
FIG. 24 is a vertical sectional view of a magnetic sleeve employed in the developer recycling unit of FIG. 23.

As shown in FIG. 24, the magnetic sleeve 324 is a cylindrical member comprised of a plurality of spirally arranged and belt-shaped magnets 325, and a magnetic pole is formed on the inner side of each of the magnets 325 in a direction longitudinally thereof. The magnetic pole of one magnet 325 differs in polarity from that of another magnet adjacent thereto such that N-poles and S-poles are alternated. The angle θ of inclination of the magnets 325 is one of control factors for controlling the speed of travel of the developer and, preferably, is chosen to be about 15°. The magnetic sleeve 324 is provided at an outer periphery thereof with a gear 326 connected to a motor 327.

The ring 322 is connected to one end of a supply pipe 328 of which the other end is connected to the cleaning unit 312 disposed upstream therefrom. The supply pipe 328 has a diameter less than that of the recycling pipe 321. A foreign substance discharge pipe 329 having a diameter less than that of the recycling pipe 321 has one end extending through the ring 323 and inserted into the recycling pipe 321 and the other end introduced into a foreign substance receptacle 330. A developer discharge recess 331 defined below a portion 333 of the foreign substance discharge pipe 329 within the recycling pipe 321 communicates the developing unit 304 via a transport pipe 332, as shown in FIG. 22.

Figure 26:
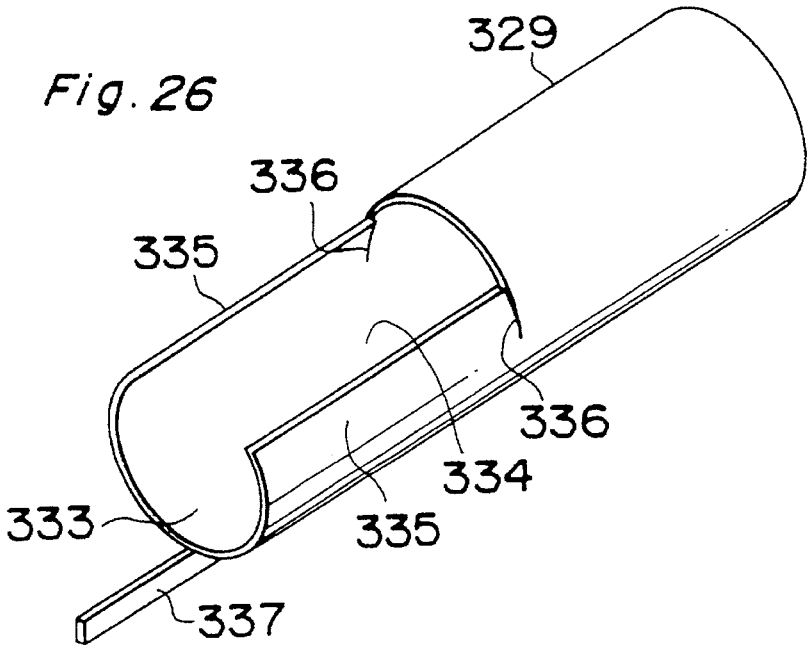
FIG. 26 is a perspective view of a foreign substance discharge pipe having one end inserted into the developer recycling unit of FIG. 23.

As shown in FIG. 26, a peripheral wall portion of the foreign substance discharge pipe 329, which is accommodated within the recycling pipe 321, is partly removed by cutting to define a generally rectangular opening 334 while allowing the remaining wall portion to represent a generally U-sectioned configuration. With this opening 334 so defined in the wall portion of the foreign substance discharge pipe 329 within the recycling pipe 321, a pair of opposite walls 335 are left on respective sides of the opening 334. Each wall 335 is delimited by a cut edge, left thereon when that peripheral wall portion is removed to form the opening 334, and two slits 336 generally circumferentially extending a slight distance enough to allow the walls 335 to be radially inwardly bent to bring the respective cut edges into contact with a spiral ring or coil 338 accommodated in the foreign substance discharge pipe 329. A distributing bar 337 is secured to a bottom end portion of the foreign substance discharge pipe 329 accommodated within the recycling pipe 321 and extends towards the ring 322 in a direction longitudinally of the recycling pipe 321.

Figure 27:
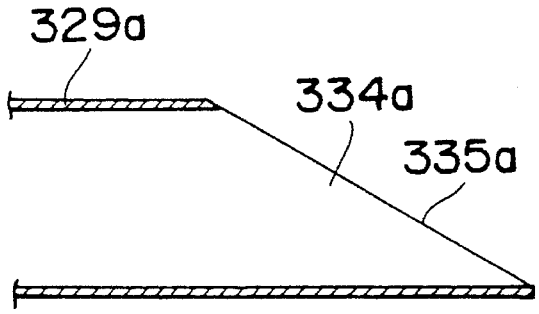
FIG. 27 is a fragmentary vertical sectional view of one end of the foreign substance discharge pipe according to a modification thereof.

FIG. 27 depicts a modification **329*a* of the foreign substance discharge pipe 329. As shown in FIG. 27, the foreign substance discharge pipe 329*a* has an elliptical opening 334*a* which is delimited by an end wall portion 335*a*** formed by obliquely cutting one end thereof.

Figure 25:
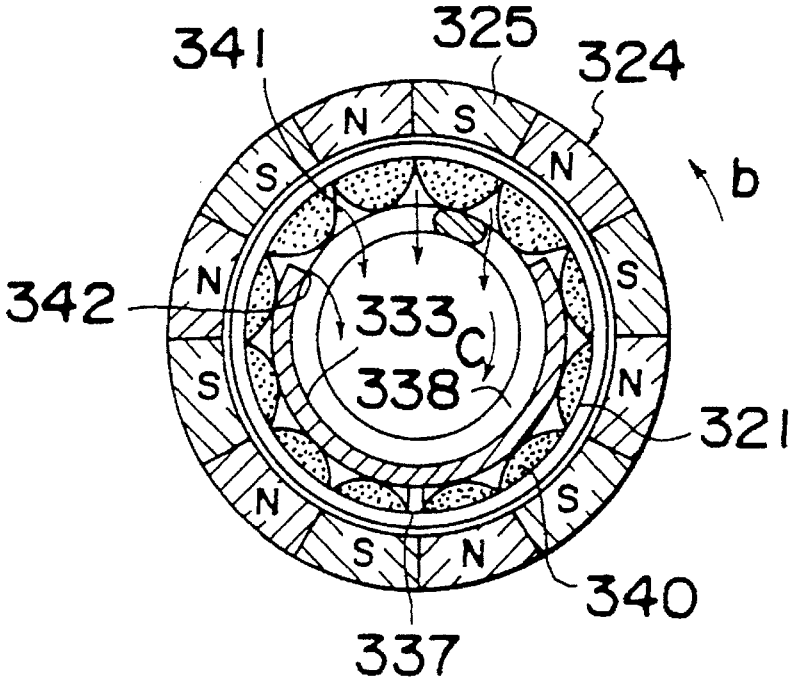
FIG. 25 is a sectional view taken along line XXV—XXV in FIG. 23.

The spiral ring 338 is connected to a motor (not shown) and extends from the cleaning unit 312 into the foreign substance discharge pipe 329 through the supply pipe 328. As previously discussed and as best shown in FIG. 25, the spiral ring 338 is in contact with upper inner portions of the side walls 335 of the foreign substance discharge pipe 329 within the recycling pipe 321. Both the recycling pipe 321 and the spiral ring 338 are connected to a power source 339 so that a voltage of the same polarity as the charged toner may be applied to the spiral ring 338. The section of the spiral ring 338 may be either circular or rectangular, or may be polygonal.

In the developer recycling assembly of the above-described construction, the operation of the motor 327 rotates the magnetic sleeve 324 in a direction of an arrow (b), and the rotation of the spiral ring 338 in a direction of an arrow (c) introduces the magnetic developer 340 accommodated in the cleaning unit 312 into the recycling pipe 321 through the supply pipe 328. If the developing unit 304 accommodates monocomponent developer consisting of magnetic toner, the magnetic developer 340 is the magnetic toner. On the other hand, if the developing unit 304 accommodates two-component magnetic developer consisting of non-magnetic toner and magnetic carrier, the magnetic developer 340 is a mixture thereof. In applications where the two-component developer is employed, the carrier is forcibly supplied from the developing unit 304 to the photosensitive drum 301 and is recovered by the cleaning unit 312 for the subsequent mixing with the non-magnetic toner.

The magnetic developer 340 introduced into the recycling pipe 321 is uniformly distributed by the distributing bar 337 and is held on the inner surface of the recycling pipe 321 under the influence of the magnetic force of the magnetic sleeve 324. The rotation of the magnetic sleeve 324 is followed by a movement of the magnetic field, which in turn causes a circumferential rotation (shown by a dotted line in FIG. 23) of the magnetic developer 340 along the inner surface of the recycling pipe 321 in the direction of the arrow (b) in FIG. 25. In this way, the magnetic developer 340 is conveyed downstream in a direction of an arrow (d) while taking the form of a magnetic brush. During the travel, non-charged toner contained in the developer 340 is appropriately charged by the contact thereof with the carrier.

When the developer 340 travels along the upper inner surface of the recycling pipe 321, non-magnetic foreign substances 341 such as, for example, paper powder or a mass of toner contained therein are separated therefrom and spontaneously drop. Such foreign substances 341 are then introduced into the foreign substance discharge pipe 329 through the opening 334. Because the developer 340 travels so as to rotate along the inner surface of the recycling pipe 321 several times, much of the foreign substances 341 contained therein are recovered. Furthermore, the biasing voltage applied between the spiral ring 338 and the recycling pipe 321 causes the reversely charged toner 342 contained in the developer to be electrically drawn to the surface of the spiral ring 338. This reversely charged toner 342 is scraped off by the side walls 335 of the foreign substance discharge pipe 329 positioned inside the recycling pipe 321 and is introduced into the foreign substance discharge pipe 329, as shown in FIG. 25. The foreign substances 341, the reversely charged toner 342 and the like thus captured are conveyed to the receptacle 330 through the foreign substance discharge pipe 329 by the rotation of the spiral ring 338.

On the other hand, the developer 340 which has traveled along the inner surface of the recycling pipe 321 and has reached the recess 331 is introduced into the transport pipe 332 and is supplied to the developing unit 304 therethrough for use in subsequent development.

Figure 28:
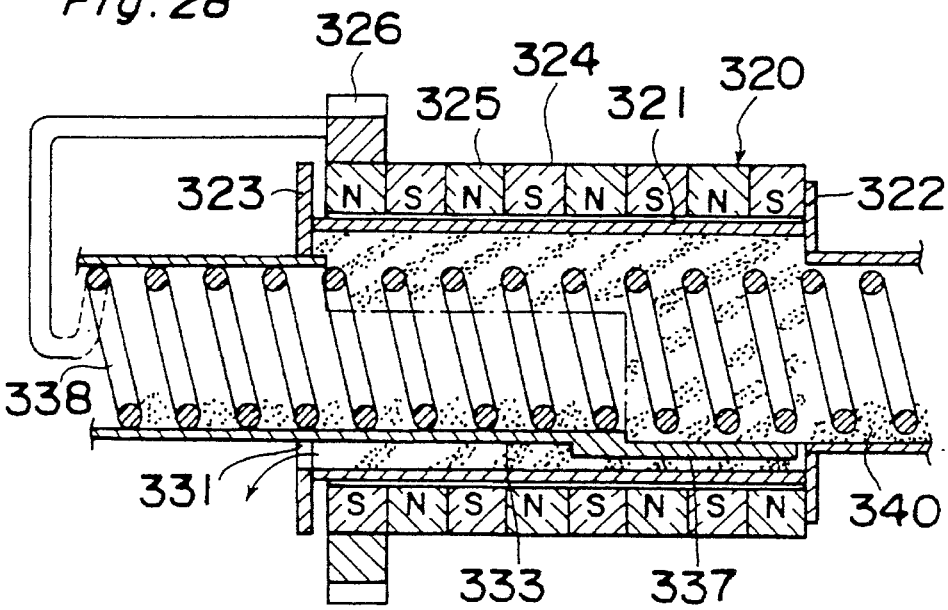
FIG. 28 is a view similar to FIG. 23, but indicating a modification thereof.

In the above-described embodiment, although the magnetic sleeve 324 and the spiral ring 338 are driven by different motors, respectively, the spiral ring 338 may be connected to the magnetic sleeve 324, as shown in FIG. 28, so that the rotation of the latter may be transmitted to the former. Alternatively, the spiral ring 338 or any other suitable conveyor means may be made of a magnetic material. In this case, the rotation of the magnetic material is followed by a movement of a magnetic field, which in turn rotates the magnetic sleeve 324.

Furthermore, the developer 340 may be conveyed along a spiral guide member, mounted on the inner surface of the recycling pipe 321, for guiding the developer 340.

In addition, the spiral ring 338 employed as a conveyor means is not necessarily required to be continuous inside the supply pipe 328 and the foreign substance discharge pipe 329, and each of them may accommodate a spiral ring dedicated for use therein.

In the above-described embodiment, although a voltage of the same polarity as the charged toner is applied to the spiral ring 338 by the power source 339 connected thereto and to the recycling pipe 321, one of a DC voltage of a polarity opposite to the polarity of the charged toner, an AC voltage, and an AC plus DC voltage may be applied thereto. The application of such voltage prevents the charged toner from adhering to the inner surface of the recycling pipe 321.

Also, the location of the distributing bar 337 is not limited to the bottom end portion of the foreign substance discharge pipe 329, and this bar 337 may be secured to any other suitable portion of the foreign substance discharge pipe 329.

Figure 29:
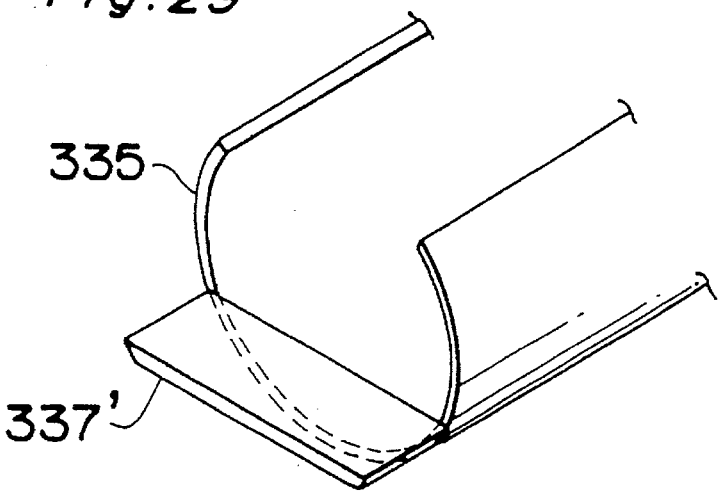
FIG. 29 is a fragmentary perspective view of one end of the foreign substance discharge pipe according to another modification thereof.
Figure 30:
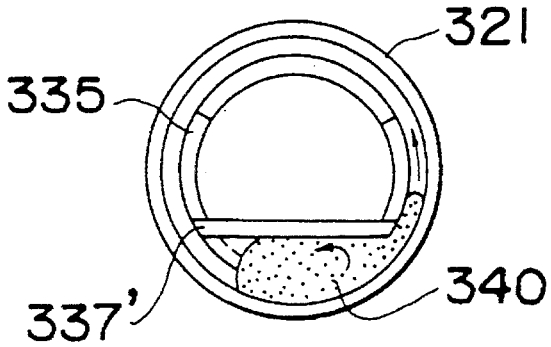
FIG. 30 is a side view of the foreign substance discharge pipe of FIG. 29.
Figure 31:
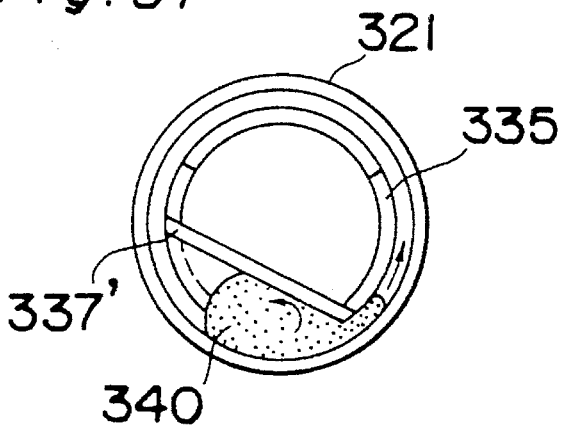
FIG. 31 is a view similar to FIG. 30, but indicating a further modification thereof.

FIGS. 29 and 30 depict an alternative of the distributing bar 337. As shown therein, a distributing plate 337' is generally horizontally secured to the opposite side walls 335 of the end portion of the foreign substance discharge pipe 329. The distributing plate 337' may be inclined as shown in FIG. 31.

Figure 32:
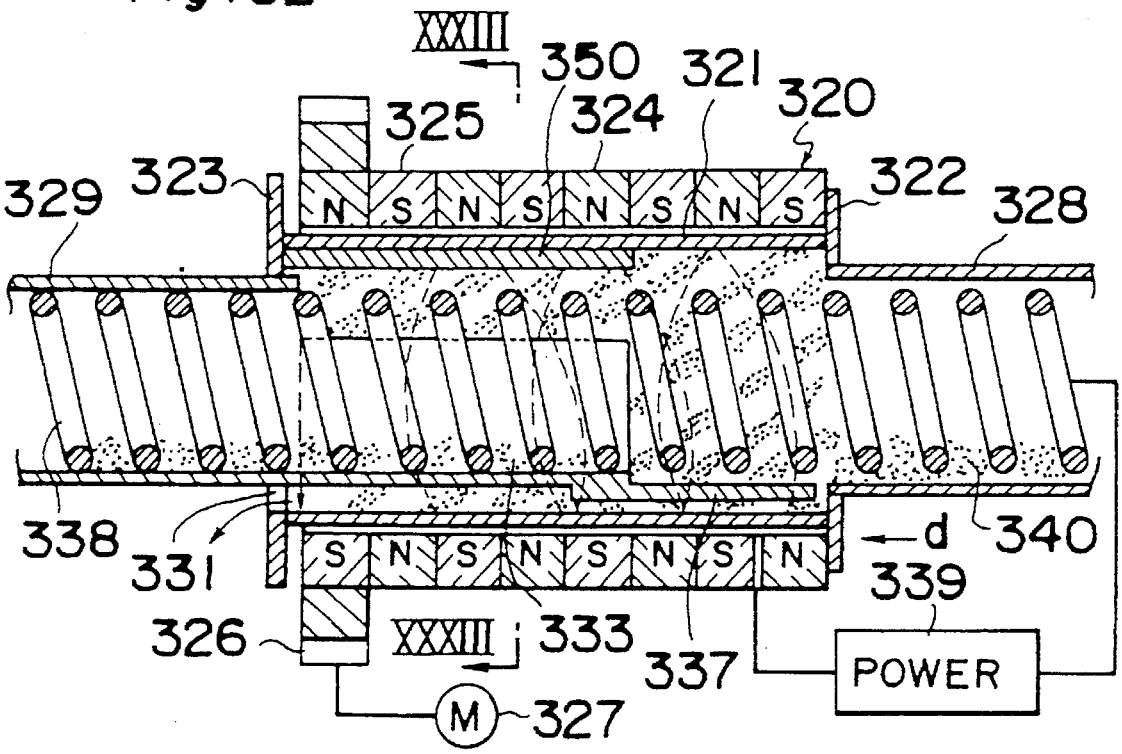
FIG. 32 is a view similar to FIG. 23, but indicating another modification thereof.
Figure 33:
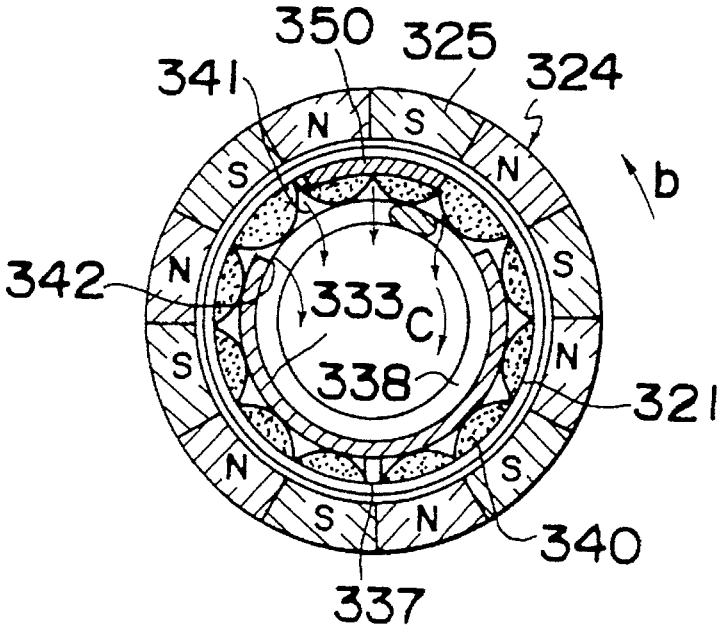
FIG. 33 is a sectional view taken along line XXXIII—XXXIII in FIG. 32.

As shown in FIGS. 32 and 33, the recycling pipe 321 may be internally provided with a curved scraper 350 movably adhering to the inner surface thereof. The scraper 350 is generally made of a magnetic material and is drawn to the inner surface of the recycling pipe 321 under the influence of the magnetic force of the magnetic sleeve 324. When the magnetic sleeve 324 is rotated, the scraper 350 is rotated simultaneously in the same direction along the inner surface of the recycling pipe 321, and toner adhering to the inner surface of the recycling pipe 321 is scraped off by a leading edge portion of the scraper 350, thereby cleaning the inner surface of the recycling pipe 321. The toner removed by the scraper 350 is mixed with the developer for recycling.

Figure 34:
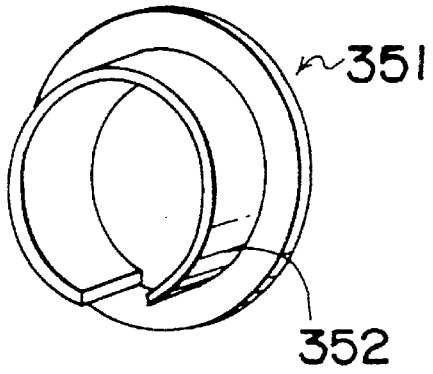
FIG. 34 is a perspective view of a guide member secured to one end of the developer recycling unit.
Figure 35:
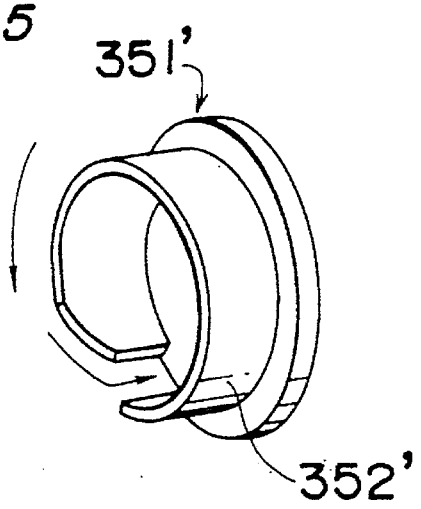
FIG. 35 is a view similar to FIG. 34, but indicating a modification thereof.

The ring 323 may be replaced by a guide member 351 having a generally horizontally extending cylindrical portion 352 secured thereto, a lower portion of which is partly removed by cutting, as shown in FIG. 34. Although opposite ends of the portion 352 are horizontally spaced, they may be vertically spaced as shown in FIG. 35 in which a horizontally extending portion 352' takes the form of a generally spiral configuration. The use of the guide member 351' shown in FIG. 35 is preferred, because the developer which is, in the case of FIG. 32, likely to be accumulated in the proximity of the ring 323 is effectively discharged.

Figure 36:
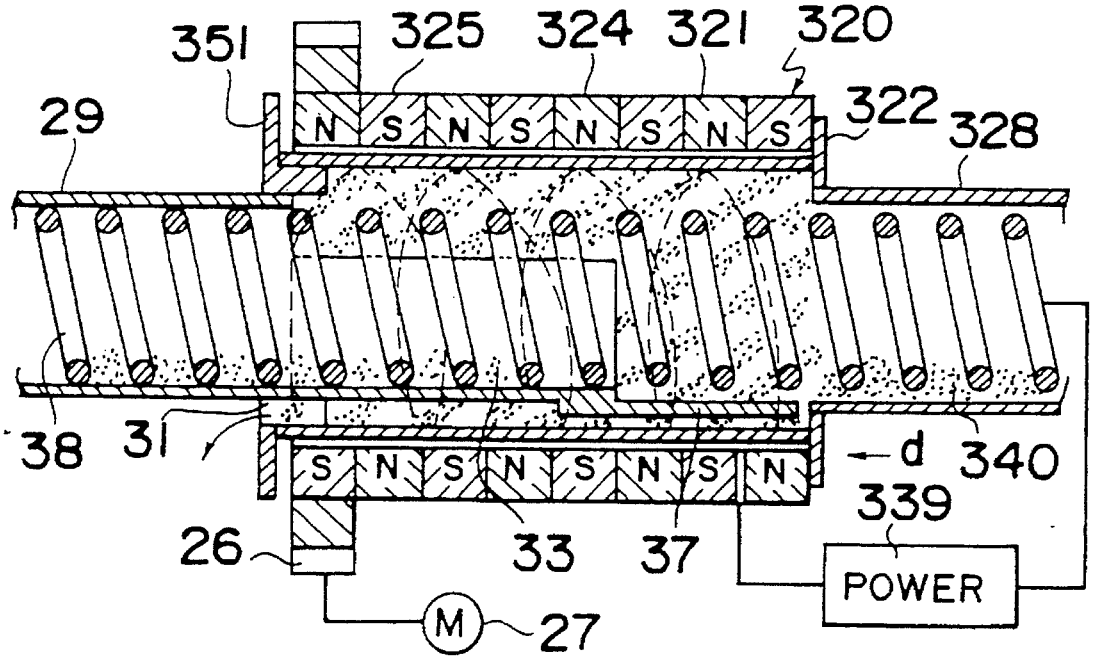
FIG. 36 is a view similar to FIG. 23, but indicating a further modification thereof to which the guide member shown in FIG. 34 or 35 is secured.

FIG. 36 depicts the developer recycling unit 320 to one end of which the guide member 351 or 351' is secured.

It is to be noted here that in the above-described embodiments, although the developer recycling assembly is employed as means for recycling the developer recovered by the cleaning unit and for supplying the developing unit with the recycled developer, the developer recycling assembly is not limited by such means and can be used at any desired place to recycle the developer by removing foreign substances therefrom.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. An image forming apparatus having an electrostatic latent image support member rotatably mounted therein comprising:

a developing unit accommodating developer for developing an electrostatic latent image formed on a surface of said electrostatic latent image support member;

a cleaning unit for recovering developer remaining on the surface of said electrostatic latent image support member after development;

a developer conveyor means for connecting said developing unit to said cleaning unit, thereby conveying the developer recovered by said cleaning unit to said developing unit, said developer conveyor means including an impurity sorting means for removing foreign substances contained in the developer recovered by said cleaning unit; and a developer supply means for supplying the developer accommodated in said developing unit to said developer conveyor means;

whereby a mixture of the developer supplied by said developer supply means and the developer recovered by said cleaning unit is resupplied to said developing unit through said developer conveyor means;

wherein said impurity sorting means separates toner particles contained in the developer from foreign substances which have been charged so as to have a polarity opposite to the polarity of the toner particles by an application of a biasing voltage.

2. An image forming apparatus having an electrostatic latent image support member rotatably mounted therein comprising:

a developing unit accommodating developer for developing an electrostatic latent image formed on a surface of the electrostatic latent image support member;

a cleaning unit for recovering developer remaining on the surface of the electrostatic latent image support member after development;

a developer conveyor unit, connected to said developing unit and to said cleaning unit, for conveying the developer recovered by said cleaning unit to said developing unit, said developer conveyor unit including a conveyor pipe and a coil rotatably mounted therein; and a developer supply means, connected to said developer conveyor unit and to said developing unit, for supplying the developer from said developing unit to the recovered developer which is on the way to be conveyed to the developing unit.

3. The image forming apparatus according to claim 2, wherein said developing unit comprises a non-magnetic cylindrical sleeve rotatably mounted therein and a magnetic roller fixedly mounted in said sleeve and having a plurality of magnetic poles formed on a peripheral surface thereof, said magnetic roller having a developer separating portion at which two magnetic poles having a same polarity are disposed adjacent to each other for separating the developer held on a surface of said sleeve therefrom, and wherein a connecting portion between said developing unit and said developer supply means is positioned in the proximity of said developer separating portion.

4. The image forming apparatus according to claim 2, wherein said developing unit comprises a developing roller rotatably mounted therein for conveying the developer held on a surface thereof and a regulating member for regulating an amount of the developer to be conveyed to a developing region defined between said electrostatic latent image support member and said developing roller, and wherein a connecting portion between said developing unit and said developer supply means is positioned in the proximity of and upstream from said regulating member in a direction of travel of the developer.

5. The image forming apparatus according to claim 2, wherein the developer accommodated in said developing unit is two-component developer containing toner and magnetic carrier, and said developing unit comprises a developing roller rotatably mounted therein for holding the developer on a surface thereof, and wherein a connecting portion between said developing unit and said developer supply means is positioned downstream from a developing region at which said developing roller confronts said electrostatic latent image support member in a direction of rotation of said developing roller.

6. The image forming apparatus according to claim 2, wherein said developer conveyor unit further comprises a cylindrical member accommodated in said conveyor pipe and secured to said coil for rotation together therewith, said cylindrical member having an opening defined therein which passes, when said cylindrical member is rotated, a connecting portion between said developer conveyor unit and said developer supply means so that a portion of the developer accommodated in said developing unit is introduced into said conveyor pipe through said opening.

7. An image forming apparatus having an electrostatic latent image support member rotatably mounted therein comprising:

a developing unit accommodating developer for developing an electrostatic latent image formed on a surface of the electrostatic latent image support member;

a cleaning unit for recovering developer remaining on the surface of the electrostatic latent image support member after development;

a developer conveyor unit, connected to said developing unit and to said cleaning unit, for conveying the developer recovered by said cleaning unit to said developing unit, said developer conveyor unit including an impurity sorting unit for removing foreign substances contained in the developer recovered by said cleaning unit; and a developer supply means, connected to said developer conveyor unit and to said developing unit, for supplying the developer from said developing unit to the recovered developer which is on the way to be conveyed to the developing unit.

8. The image forming apparatus according to claim 7, wherein said developer is magnetic developer and wherein said impurity sorting unit separates said magnetic developer from non-magnetic foreign substances by an action of a magnetic force.

9. An image forming apparatus having an electrostatic latent image support member rotatably mounted therein comprising:

a developing unit accommodating developer for developing an electrostatic latent image formed on a surface of the electrostatic latent image support member;

a cleaning unit for recovering developer remaining on the surface of the electrostatic latent image support member after development;

a developer conveyor unit, connected to said developing unit and to said cleaning unit, for conveying the developer recovered by said cleaning unit to said developing unit, said developer conveyor unit including an impurity sorting unit for removing foreign substances contained in the developer recovered by said cleaning unit; and a developer supply means, connected to said developer conveyor unit and to said developing unit, for supplying the developer from said developing unit to the recovered developer which is on the way to be conveyed to the developing unit;

wherein said impurity sorting unit separates toner particles contained in the developer from foreign substances which have been charged so as to have a polarity opposite to the polarity of the toner particles by an application of a biasing voltage.

10. An image forming apparatus having an electrostatic latent image support member rotatably mounted therein comprising:

a developing unit accommodating magnetic developer for developing an electrostatic latent image formed on a surface of the electrostatic latent image support member;

a cleaning unit for recovering magnetic developer remaining on the surface of the electrostatic latent image support member after development;

a developer conveyor unit, connected to said developing unit and to said cleaning unit, for conveying the magnetic developer recovered by said cleaning unit to said developing unit, said developer conveyor unit including an impurity sorting unit for removing foreign substances contained in the developer recovered by said cleaning unit; and a magnetic field generating means, disposed inwardly of a non-image region defined at one or more end portion of said electrostatic latent image support member, for generating a magnetic field to thereby magnetically hold the magnetic developer on the surface of said electrostatic latent image support member so that the magnetic developer is supplied from said developing unit to said cleaning unit.

11. The image forming apparatus according to claim 10, wherein said magnetic field generating means comprises a magnetic sheet overlaid on an inner surface of said electrostatic latent image support member at said non-image region.

12. The image forming apparatus according to claim 10, wherein said magnetic field generating means comprises a first magnetic material secured to a first end of a holder which is in engagement with said electrostatic latent image support member for rotation together therewith.

13. The image forming apparatus according to claim 12, wherein said developing unit comprises a developing roller rotatably mounted therein and wherein a second magnetic material is secured to a second end of said holder, each of said fist and second magnetic materials having an outwardly directed magnetic pole of a polarity opposite to a polarity of a developing magnetic pole of said developing roller.

14. The image forming apparatus according to claim 13, wherein said holder can radially move between a first position at which the magnetic developer is held on the surface of said electrostatic latent image support member by said magnetic field generating means and a second position at which the magnetic developer is separated from the surface of said electrostatic latent image support member, said holder being located at said second position when said second magnetic material is drawn to said developing roller.

15. The image forming apparatus according to claim 10, wherein said impurity sorting unit separates the magnetic developer from non-magnetic foreign substances by an action of a magnetic force.

16. The image forming apparatus according to claim 10, wherein said impurity sorting unit separates toner particles contained in the developer from foreign substances which have been charged so as to have a polarity opposite to a polarity of the toner particles by an application of a biasing voltage.

17. An image forming apparatus having an electrostatic latent image support member rotatably mounted therein comprising:

a developing unit accommodating magnetic developer for developing an electrostatic latent image formed on a surface of the electrostatic latent image support member;

a cleaning unit for recovering magnetic developer remaining on the surface of the electrostatic latent image support member after development;

a developer conveyor unit, connected to said developing unit and to said cleaning unit, for conveying the magnetic developer recovered by said cleaning unit to said developing unit; and a developer recycling unit comprising: a cylindrical recycling pipe; a magnetic sleeve having a plurality of belt-shaped magnetic poles extending along an outer peripheral surface of said recycling pipe; a developer supply pipe having one end connected to an upstream end of said recycling pipe in a direction of travel of the developer; a foreign substance discharge pipe having one end inserted into and connected to a downstream end of said recycling pipe in the direction of travel of the developer, an upper portion of said one end of said foreign substance discharge pipe being removed; a developer discharge portion formed at a portion of said downstream end of said recycling pipe; a developer conveyor means mounted in said developer supply pipe and said foreign substance discharge pipe; and a driving means for driving said magnetic sleeve.

18. An image forming apparatus having an electrostatic latent image support member rotatably mounted therein comprising:

a developing unit accommodating magnetic developer for developing an electrostatic latent image formed on a surface of the electrostatic latent image support member;

a cleaning unit for recovering magnetic developer remaining on the surface of the electrostatic latent image support member after development;

a developer conveyor unit, connected to said developing unit and to said cleaning unit, for conveying the magnetic developer recovered by said cleaning unit to said developing unit; and a developer recycling unit comprising: a cylindrical recycling pipe; a magnetic sleeve having a plurality of belt-shaped magnetic poles spirally extending along an outer peripheral surface of said recycling pipe; a developer supply pipe having one end connected to an upstream end of said recycling pipe in a direction of travel of the developer; a foreign substance discharge pipe having one end inserted into and connected to a downstream end of said recycling pipe in the direction of travel of the developer, said one end of said foreign substance discharge pipe within said recycling pipe being spaced from an inner peripheral surface of said recycling pipe and an upper portion thereof being removed; a developer discharge portion formed at a portion of said downstream end of said recycling pipe; a developer conveyor means mounted in said developer supply pipe and said foreign substance discharge pipe; and a rotating means for rotating said magnetic sleeve, thereby rotating the developer supplied from said developer supply pipe along the inner peripheral surface of said recycling pipe and conveying the developer towards said foreign substance discharge pipe and said developer discharge portion.

19. The image forming apparatus according to claim 18, further comprising means for applying to said developer conveyor means a biasing voltage of a same polarity as a polarity of the developer.

20. The image forming apparatus according to claim 18, further comprising means for periodically applying to said developer conveyor means a biasing voltage of a polarity opposite to a polarity of the developer.

21. The image forming apparatus according to claim 18, further comprising means for applying an AC voltage to said developer conveyor means.

22. The image forming apparatus according to claim 18, wherein said magnetic sleeve comprises a plurality of spirally arranged and belt-shaped magnets which take the form of a cylindrical member as a whole, and each of said magnetic poles is formed on an inner peripheral surface of each of said magnets and extends longitudinally thereof.

23. The image forming apparatus according to claim 22, wherein a polarity of each of said magnets differs from that of another magnet adjacent thereto.

24. In an image forming apparatus having a rotatable electrostatic latent image support member and a developing unit accommodating a magnetic developer to be supplied to an electrostatic latent image formed on a surface of said electrostatic latent image support member upon development, a method comprising the steps of:

electrostatically holding the magnetic developer on an image region of the electrostatic latent image support member;

magnetically holding the magnetic developer on a nonimage region of the electrostatic latent image support member;

recovering the magnetic developer held on the image region of the support member and the developer held on the nonimage region of the support member after development;

mixing the magnetic developer recovered from the image region of the support member and the magnetic developer recovered from the nonimage region of the support member; and resupplying the mixed developer to the developing unit.

* * * * *